US009737790B2

(12) United States Patent
Ross

(10) Patent No.: US 9,737,790 B2
(45) Date of Patent: Aug. 22, 2017

(54) BILLIARD RACK

(71) Applicant: Michael J. Ross, Lagrange, OH (US)

(72) Inventor: Michael J. Ross, Lagrange, OH (US)

( * ) Notice: Subject to any disclaimer, the term of this patent is extended or adjusted under 35 U.S.C. 154(b) by 0 days.

(21) Appl. No.: 14/512,882

(22) Filed: Oct. 13, 2014

(65) Prior Publication Data

US 2016/0101345 A1 Apr. 14, 2016

(51) Int. Cl.
*A63D 15/00* (2006.01)

(52) U.S. Cl.
CPC ..... *A63D 15/005* (2013.01); *A63D 15/006* (2013.01)

(58) Field of Classification Search
CPC ..... A63D 15/005; A63D 15/006
USPC ..... 446/40, 26, 41, 21, 46, 48; 473/173, 40, 473/26, 41, 21; 403/203
See application file for complete search history.

(56) References Cited

U.S. PATENT DOCUMENTS 3,236,519 A * 2/1966 Leigh ..... A63D 15/005 211/14
3,672,671 A * 6/1972 Merola ..... A63D 15/005 473/40
4,452,450 A * 6/1984 Cayton ..... A63D 15/005 473/40
5,556,341 A 9/1996 Bonn
5,601,495 A 2/1997 Silverman
5,735,750 A 4/1998 Silverman
5,916,032 A 6/1999 Stoll
6,629,897 B2 10/2003 Belknap
7,063,620 B2 6/2006 Nearhood
7,188,737 B2 3/2007 Mccormick et al.
D577,790 S 9/2008 Yovanovich et al.
7,448,954 B1 11/2008 Reynolds
7,666,105 B2 2/2010 Ball et al.
7,731,596 B1 * 6/2010 Yovanovich ..... A63D 15/005 473/26
7,785,209 B1 8/2010 Targosz et al.
8,181,776 B2 5/2012 Taggart et al.
8,574,089 B1 * 11/2013 Bova ..... A63D 15/005 473/40
2002/0107076 A1 * 8/2002 Porper ..... A63D 15/005 473/40
2005/0130754 A1 * 6/2005 Fliedner ..... A63D 15/005 473/40

* cited by examiner

*Primary Examiner* — Aarti B Berdichevsky
*Assistant Examiner* — Rayshun Peng
(74) *Attorney, Agent, or Firm* — Ralph E. Jocke; Walker & Jocke

(57) ABSTRACT

A billiard rack is provided that includes a frame that extends around an interior space that is configured to receive a set of billiard balls resting on a bed of a billiard table. A bottom side of the frame includes a lower opening in which the upper portions of the set of billiard balls are able to extend therein. The frame also includes an inner wall having at least one cam surface that extends at least partially around the interior space and that tapers inwardly in directions from the lower opening to an upper opening. When the frame is placed on the set of billiard balls resting on the bed of the billiard table, the at least one cam surface is configured to contact all of the peripheral billiard balls of the set of billiard balls; and urge the set of billiard balls together without the rack contacting the billiard table.

24 Claims, 30 Drawing Sheets

BILLIARD RACK

BACKGROUND

Billiards is a sport involving the use of a cue stick to hit a billiard ball on a generally planar surface. As used herein, billiards is a generic term used to refer to different types of cue sports including pool, snooker, English billiards, Caram billiards, or any other cue sport that involves hitting a billiard ball with a cue stick. Within each of these different types of billiard sports, there are various different games which specify rules for how the games are played. For example, in the billiard sport of pool, pool games include Eight Ball, Nine Ball, and Three-Ball.

Also, as used herein, a billiard ball refers to a spherical ball having a diameter in the range of 2.0 inches (50.8 mm) and 2.5 inches (63.5 mm) that is typically made of a crack/chip resistant plastic (such as a phenolic resin or a polyester). Governing bodies for different types of billiard sports may specify more specific dimensions in this range for regulation compliant billiard balls. For example, the World Pool-Billiard Association (WPA) specifies that a billiard ball for the game of pool has a diameter of 2.25 in. (57.15 mm), plus or minus 0.005 in. (0.127 mm). Also, in snooker, billiard balls may be 2 and 1/16 inches (52.5 mm) in diameter.

Billiard sports are played on a billiard table which has a rectangular horizontal planar surface called a bed that is bounded on four sides by cushions mounted along rails. The bed is often comprised of a cloth covered slate and the cushions are often comprised of a cloth covered rubber. The dimensions of a billiard table vary widely. For example, common pool tables have lengths that are 9-foot (2.7 m), 8 ft (2.4 m), or 7 ft (2.1 m) with a length to width radio of 2:1. The bed playing surface between the cushions and rails of a 9 foot (2.7 m) table, for example, may be 100 inches (254 cm) by 50 inches (127 cm). Also, for example, a snooker table may have dimensions of 11 feet 8.5 inches (356.9 cm) by 5 feet 10 inches (177.8 cm). It should also be appreciated that billiard tables for pool and snooker may include pockets for receiving billiard balls, whereas billiard tables for Carom billiards tables do not have pockets.

Billiard sports may benefit from improvements.

SUMMARY

The following is a brief summary of subject matter that is described in greater detail herein. This summary is not intended to be limiting as to the scope of the claims.

In one example embodiment of one or more inventions described herein, a billiard rack is provided that facilitates racking a set of billiard balls on a billiard table. The billiard rack may be comprised of a frame that extends around an interior space. The interior space may have a size and shape that is configured to receive therein upper portions of a set of billiard balls resting on the horizontal planar surface of a bed of a billiard table.

The frame includes a top side and an opposed bottom side. The bottom side includes a lower opening into the interior space in which the upper portions of the billiard balls are able to extend therein. The top side may include an upper opening into the interior space that is larger than a billiard ball and is smaller in area than the lower opening. The frame also includes an inner wall having at least one cam surface that extends at least partially around the interior space and that tapers inwardly in directions from the lower opening to the upper opening.

In this described embodiment, when the frame is placed on the set of billiard balls resting on the planar surface of the bed of the billiard table, the at least one cam surface is configured to: contact all of the peripheral billiard balls of the set of billiard balls; and urge the set of billiard balls together, such that each billiard ball is in contact with at least two other neighboring billiard balls and no portion of the frame comes closer than one third of the diameter of one of the billiard balls to the horizontal planar surface of the bed of the billiard table upon which the billiard balls are resting. It should be noted that when the rack is placed on the set of billiard balls, the motion of the rack is generally linear (i.e., vertically downwardly), thus the at least one cam surface corresponds to a linear cam and the followers correspond to the billiard balls.

In different example embodiments, the interior area of the frame, the upper opening, the lower opening, and/or the frame itself, may have various shapes, including generally triangular shapes, generally rhombus shapes, and generally circular shapes in order to accommodate different numbers of billiard balls in different geometric patterns.

For example, the frame and the lower opening may have a generally triangular shape and the interior space of the frame may have a shape that receives a set of fifteen billiard balls simultaneously extending into the lower opening. In this example, the at least one cam surface is configured to contact all of the twelve peripheral billiard balls of the set of fifteen billiard balls and urge the set of fifteen billiard balls together in a generally triangular shape, such that each billiard ball is in contact with at least two neighboring billiard balls.

In some examples of a billiard rack, the interior space of the frame may have a shape that is operative to receive and rack sets of billiards balls with different numbers of billiard balls for each set, such that each set extends into the lower opening with the at least one cam surface configured to contact all of the peripheral billiard balls of each set of billiard balls and urge each set of billiard balls together, such that each billiard ball is in contact with at least two neighboring billiard balls. For example, a frame that can tightly rack fifteen billiard balls in a generally triangular shape may also be able to tightly rack a lesser number billiard balls (such as fourteen, thirteen, twelve, eleven, ten or nine billiard balls).

It should also be appreciated that the generally triangularly shaped frame may be additionally used to rack an even lesser number of balls (such as three or six billiard balls) via using fingers or an edge of the rail of a billiard table to tightly urge the smaller numbers of billiard balls tightly towards portions of the at least one cam surface.

In another example, the frame and the lower opening may have a generally non-square rhombus shape and the interior space of the frame may have a shape that receives a set of nine billiard balls extending into the lower opening. In this example, the at least one cam surface contacts all eight of the peripheral billiard balls of the set of nine billiard balls and urges the set of nine billiard balls together in a generally non-square rhombus shape, such that each billiard ball is in contact with at least two neighboring billiard balls.

Also, the rack with the generally non-square rhombus shape may be used to rack a different number of billiard balls. In this example, the interior space of the frame may also have a shape that receives a set of six billiard balls extending into the lower opening. The at least one cam surface contacts all six of the billiard balls and urges the set of six billiard balls together, such that each billiard ball is in contact with at least two neighboring billiard balls. In addition, the same rack with the generally non-square rhombus shape that may be operative to tightly rack nine or six billiard balls may also be operative to tightly rack eight, seven, five, or four billiard balls.

It should also be appreciated that the generally non-square rhombus shaped frame may be additionally used to rack an even lesser number of balls (such as three billiard balls) via using fingers or an edge of the rail of a billiard table to tightly urge the smaller numbers of billiard balls tightly towards portions of the at least one cam surface. In addition, it should also be appreciated that such a generally non-square rhombus shaped frame may have a larger size to accommodate a larger numbers of billiards balls (e.g., such as sixteen billiard balls, or another number of billiard balls).

In example embodiments, the top and bottom surfaces of the frame may have generally flat surfaces or other types of surface geometries including rounded surfaces. For example, in an embodiment, the top side of the frame may include a substantially planar top surface that extends around the upper opening. Also, in the same frame, the bottom side of the frame may include a substantially planar bottom surface that extends around the lower opening and that is parallel to the planar top surface. The at least one cam surface may extend from the bottom side towards to top side at acute angles between 30 and 60 degrees (such as about 45 degrees) with respect to a plane that includes the substantially planar bottom surface.

The frame may also include different side surfaces including tapered surfaces and beveled surfaces. For example, an embodiment of the frame may include a circumferential outer side surface that extends between the top side and bottom side of the frame. The outer side surface may include a beveled portion that forms a channel having a depth that is operative to receive tips of human fingers therein in order to facilitate grasping and lifting of the frame off of the set of billiard balls.

In an example embodiment, the frame of the billiard rack may include indicia such as alignment marks on the surfaces of the frame that are used to assist in placing billiard balls on the bed of the billiard table. For example, the top side of the frame may include an outer circumferential edge. The top side of the frame may also include a plurality of spaced apart alignment marks adjacent the outer circumferential edge. In an example embodiment, the spaced apart alignment marks may correspond to notches that extend into the outer circumferential edge of the top side of the frame.

In addition, in a further example embodiment, the top side of the frame may include at least one substantially straight inner edge along the top opening that further assists in aligning billiard balls on the bed of the billiard table. In this example embodiment, when the bottom side of the frame is placed on a horizontal surface, the at least one straight inner edge may extend along a line that is substantially horizontally aligned with one or two alignment marks on the outer circumferential edge of the top side of the frame.

In a further example embodiment, the frame and the upper and lower openings may have a circular shape. In this example, the frame includes a circumferential outer side surface that extends between the top side and bottom side of the frame and that may taper inwardly in directions from the top side to the bottom side of the frame. Such a circular billiard rack may have a cam surface with a sufficient size that is capable of racking different numbers (e.g. ten, nine, and eight) of billiard balls in a ring arrangement. Such a circular billiard rack may also be flipped over and placed on a billiard table in order to function as a game piece during a game of billiards.

In addition, the circular billiard rack may be associated with a relatively smaller disc that is used to play billiard games by itself or in combination with the circular billiard rack. Such a disc may have an outer diameter that is less than an inner diameter of the upper opening of the circular billiard rack and may be placed inside the opening of the circular billiard rack for various billiard games. The disc may include a circumferential outer side surface that extends between a top side and a bottom side of the disc and that may taper inwardly in directions from the bottom side to the top side of the disc. In this example, the top side of the disc may include a central aperture having a diameter that is less than the diameter of a billiard ball. This aperture may taper inwardly in directions from the top side to the bottom side of the disc in order to receive and hold a single billiard ball thereon.

In example embodiments, the example billiard racks described herein may be used in various methods of setting up (i.e., racking) an arrangement of a set of billiard balls. For example, a method of using one or more of the previously described embodiments of a billiard rack may include: placing the frame on the set of billiard balls resting on the horizontal planar surface of the bed of the billiard table; contacting with the at least one cam surface, all of the peripheral billiard balls of the set of billiard balls; and urging with the at least one cam surface, the set of billiard balls together, such that each billiard ball is in contact with at least two other neighboring billiard balls and no portion of the frame comes closer than one third of the diameter of one of the billiard balls to the horizontal planar surface of the bed of the billiard table upon which the billiard balls are resting. The method may also include lifting the frame off of the set of billiard balls, resulting in a tightly racked set of billiard balls that is ready to be hit with a cue ball during a billiard game.

In another example method, with respect to the described frame that is used to rack nine billiard balls in a non-square rhombus arrangement, the method may comprise repeating the racking step by racking six billiard balls instead of nine billiard balls. In addition, in another example where the side surfaces of the frame are beveled, the method may include placing tips of human fingers adjacent the beveled portions to facilitate easier grasping and lifting of the frame off of a set of billiard balls.

Further, in another example where the outer circumferential edge of the frame includes alignment marks, an example method may include: aligning at least one billiard ball adjacent to the outer circumferential edge and at least one alignment mark. Also, in another example, a method may include: aligning at least one substantially straight inner edge of the top opening of the frame with a spot on a billiard table. This method may also include aligning at least one billiard ball adjacent the outer circumferential edge and at least one alignment mark and the at least one substantially straight inner edge along the top opening of the frame.

Also, in example embodiments that include the previously described disc and/or circular billiard rack, a method may include: shooting a billiard ball with a cue stick in order to drive the billiard ball up the outer tapered surface of the disc and/or a circular billiard rack. Depending on the game being played, this may be done so as to make the billiard ball land and remain on the aperture of the disc, roll around tapered portions of the disc and circular billiard rack, and/or land inside the circular billiard rack.

Other aspects will be appreciated upon reading and understanding the attached Figures and description.

DETAILED DESCRIPTION

Figure 1:
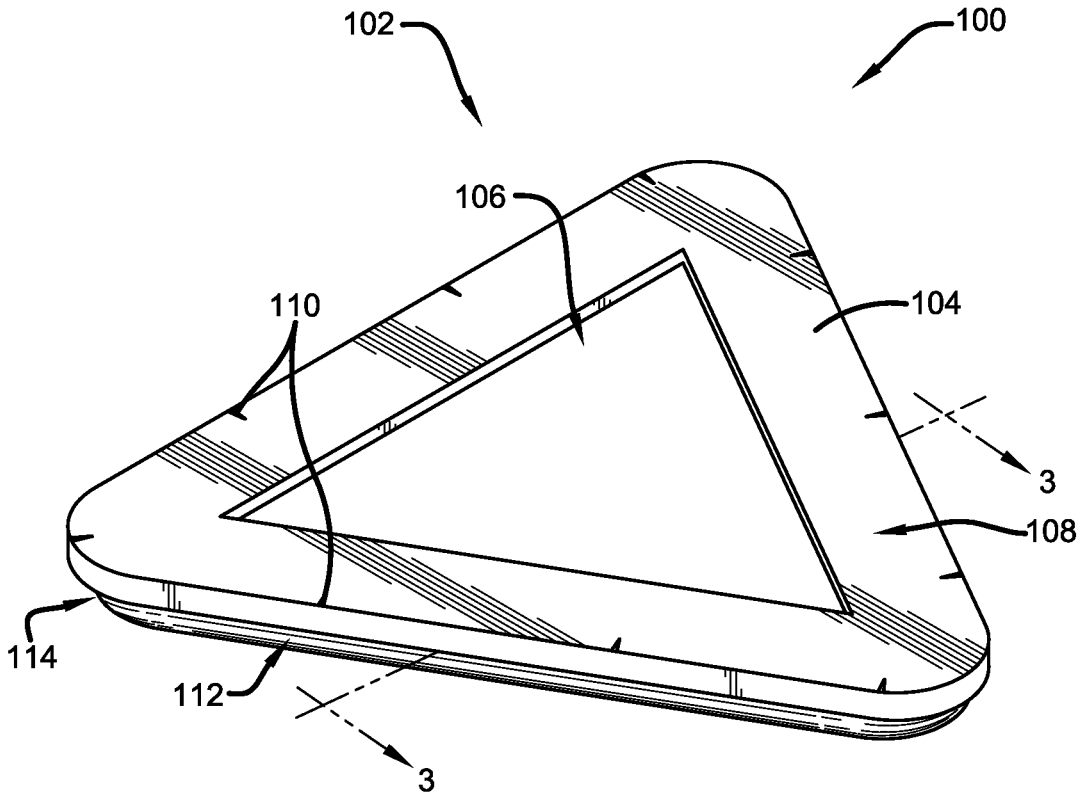
FIG. 1 is a front right side perspective view of a billiard rack that facilitates racking a set of fifteen billiard balls in a generally triangular shape.

Various technologies pertaining to billiards will now be described with reference to the drawings, where like reference numerals represent like elements throughout. Also, it is to be understood that functionality that is described as being carried out by certain components or surface configurations may be performed by multiple components or surface configurations. Similarly, for instance, a component or surface configuration may be configured to perform functionality that is described as being carried out by multiple components or surface configurations.

With reference to FIG. 1, a perspective view 100 of an example billiard rack 102 that facilitates racking a set of billiard balls is illustrated. The billiard rack 102 includes a frame 104 that extends around an interior space 106. As shown in FIG. 1, the frame has a top side 108 which in this example may be substantially planar (i.e., flat). However, it should be appreciated that in alternative embodiments, the top side of the rack may have other contours such as a rounded surface, a tapered surface, a conical surface, or any other surface configuration that does not interfere with the arrangement of the billiard balls described herein.

Figure 2:
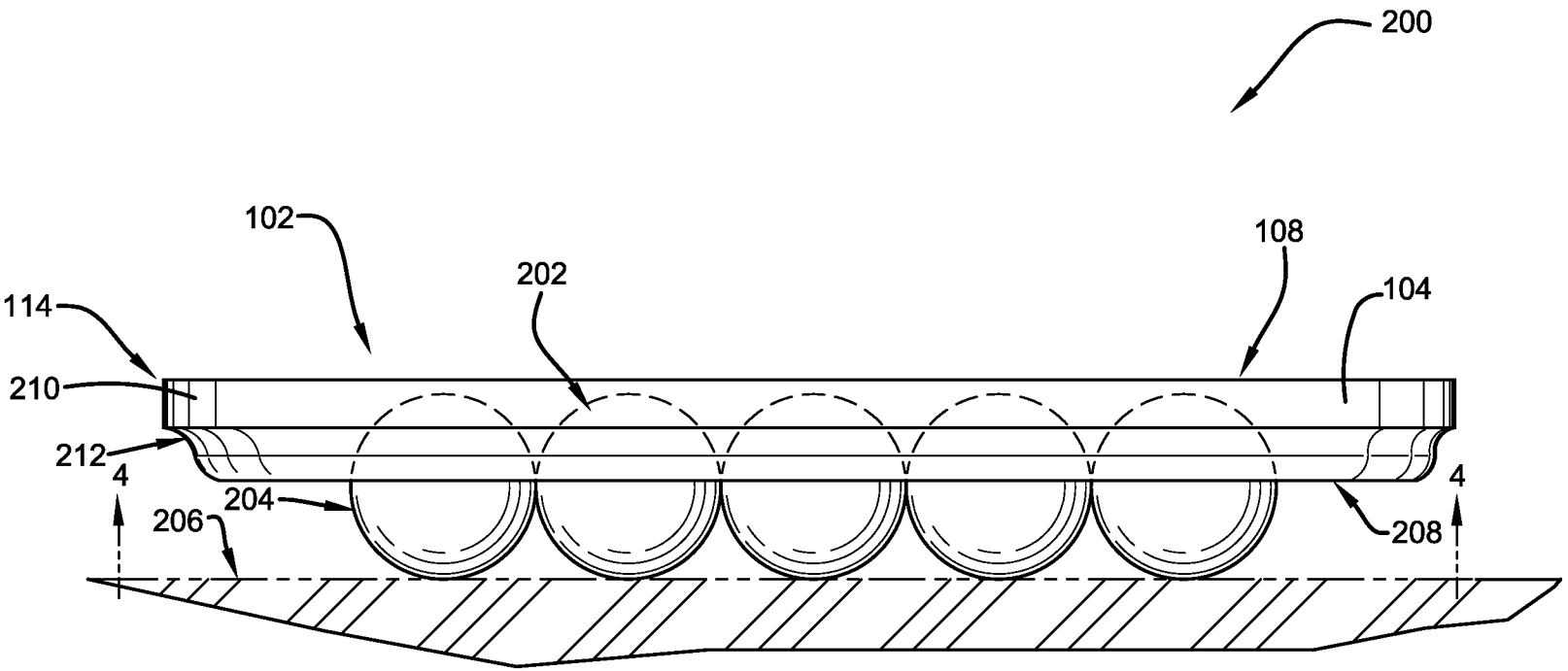
FIG. 2 is a side view of the billiard rack.

FIG. 2 illustrates a side view 200 of the rack that is positioned to tightly arrange (i.e., rack) a set of billiard balls. As shown in FIG. 2, the interior space may have a size and shape that is configured to receive therein upper portions 202 of the set of billiard balls 204 resting on the horizontal planar surface 206 of a bed of a billiard table. In this example, the top side 108 of the frame faces upwardly and an opposed bottom side 208 of the frame faces downwardly.

Figure 3:
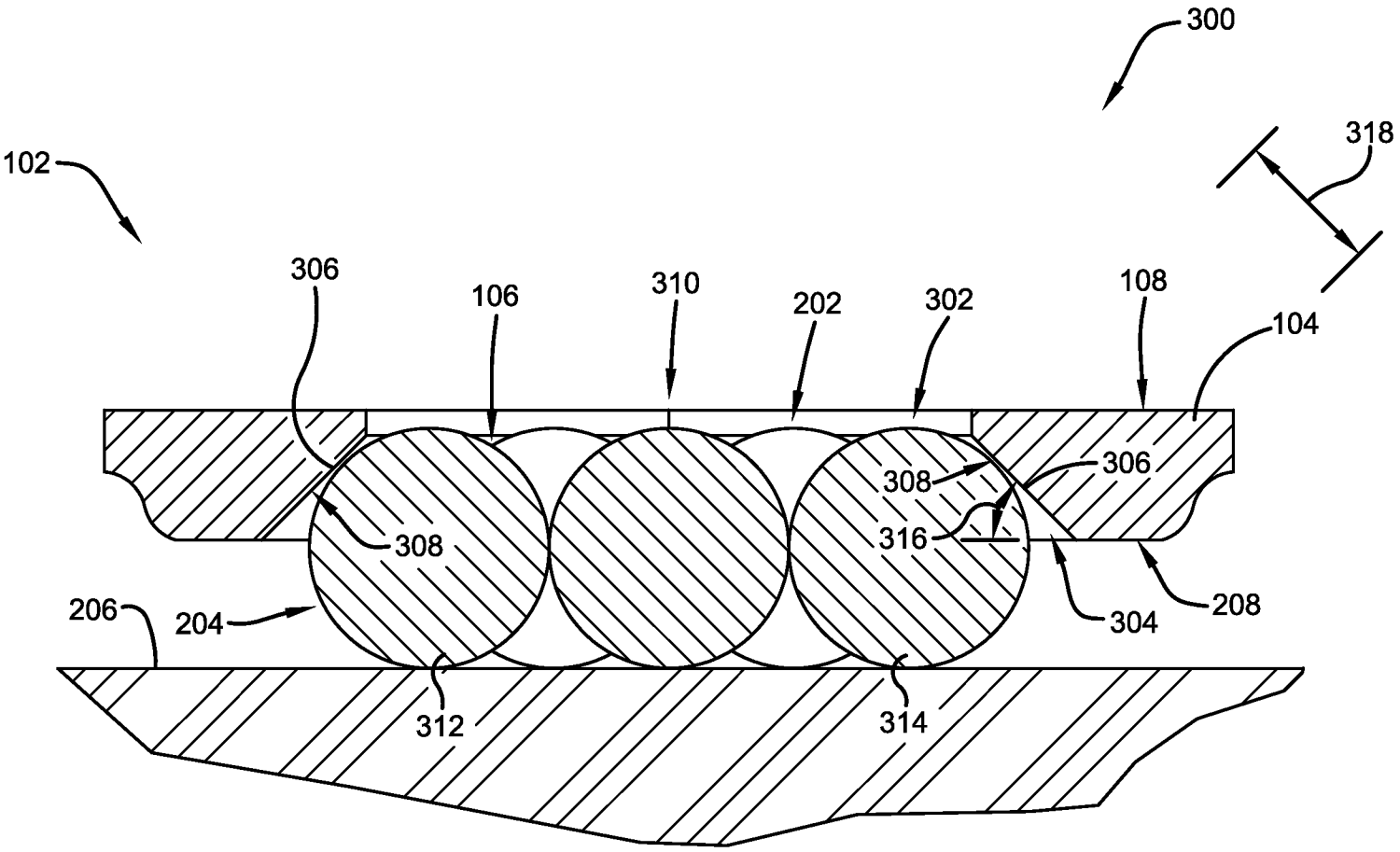
FIG. 3 is a cross-sectional view of the billiard rack.

FIG. 3 illustrates a cross-sectional view 300 of the rack. To enable the balls to extend in the interior area of the frame, the bottom side 208 of the frame 104 includes a lower opening 304 into the interior space 106 in which the upper portions 202 of the billiard balls are able to extend therein. The top side 108 may include an upper opening 302 into the interior space 106 that is larger than a billiard ball but is smaller in area than the lower opening 304.

The frame 104 also includes an inner wall 306 that bounds the interior space 106 and that has at least one cam surface 308. The cam surface 308 extends at least partially around the interior space. The cam surface is also configured so as to taper inwardly (toward the center 310 of the frame) at acute angles in directions from the lower opening 304 to the upper opening 302.

In this described embodiment, when the frame is placed on the set of billiard balls 204 resting on the planar surface 206 of the bed of the billiard table, the at least one cam surface is configured to: contact all of the peripheral billiard balls (such as billiard balls 312, 314) of the set of billiard balls 204; and urge the set of billiard balls together (with the billiard balls remaining in contact with the bed of the billiard table). The billiard balls are urged together such that each billiard ball is in contact with at least two other neighboring billiard balls and no portion of the frame comes closer than one third of the diameter of one of the billiard balls to the horizontal planar surface of the bed of the billiard table upon which the billiard balls are resting. For example, the billiard rack may rest above the bed of the billiard table by more than 0.66 inches (1.68 cm).

It should be appreciated that in the view shown in FIG. 3, the portion of cam surface 308 that contacts the peripheral billiard balls 312, 314 is located behind the visible portions of these billiard balls. Also, it should be noted that in some example embodiments (such as in FIG. 3) the billiard frame may rest on the billiard balls and remain an even larger distance from the bed of the billiard table, such that the billiard frame rests on the tightly racked set of billiard balls with all portions of the billiard rack being higher than the bed of the billiard table by more than 50% of the diameter of a billiard ball (e.g., more than one inch or 2.54 cm. above the bed of the billiard table).

In example embodiments, these described distances above the bed of the table are operative to facilitate tightly racking the set of billiard balls quickly without the bed of the billiard table interfering with the ability of the billiard rack to tightly rack the set of billiard balls together. Further, the amount of space remaining under the billiard rack after the balls have been tightly racked is sufficient to place a person's fingers under the bottom side of the billiard rack for purposes of repositioning the billiard rack and/or lifting the billiard rack without knocking into and disrupting the tightly packed arrangement of billiard balls. Further, the amount of space remaining under the billiard rack after the balls have been tightly racked provides sufficient visibility under the rack so that a person can see where a corner billiard ball contacts the bed of the billiard table in order to align the corner billiard ball with a spot on the billiard table (e.g., one of the head, foot, or center spots of a billiard table).

In addition, in some embodiments the body of the billiard tack may have a sufficient weight to tightly rack a set of billiard balls together without the need for a person to push downwardly on the rack. Rather, gravity acting on the billiard rack may be sufficient for some embodiments to urge the frame downwardly with sufficient force to tightly rack a set of billiard balls. In an example embodiment such as shown in FIG. 3, the weight of the frame may be greater than 1.0 pounds (0.45 kg), for example such as about 1.25 pounds (0.57 kg).

Figure 4:
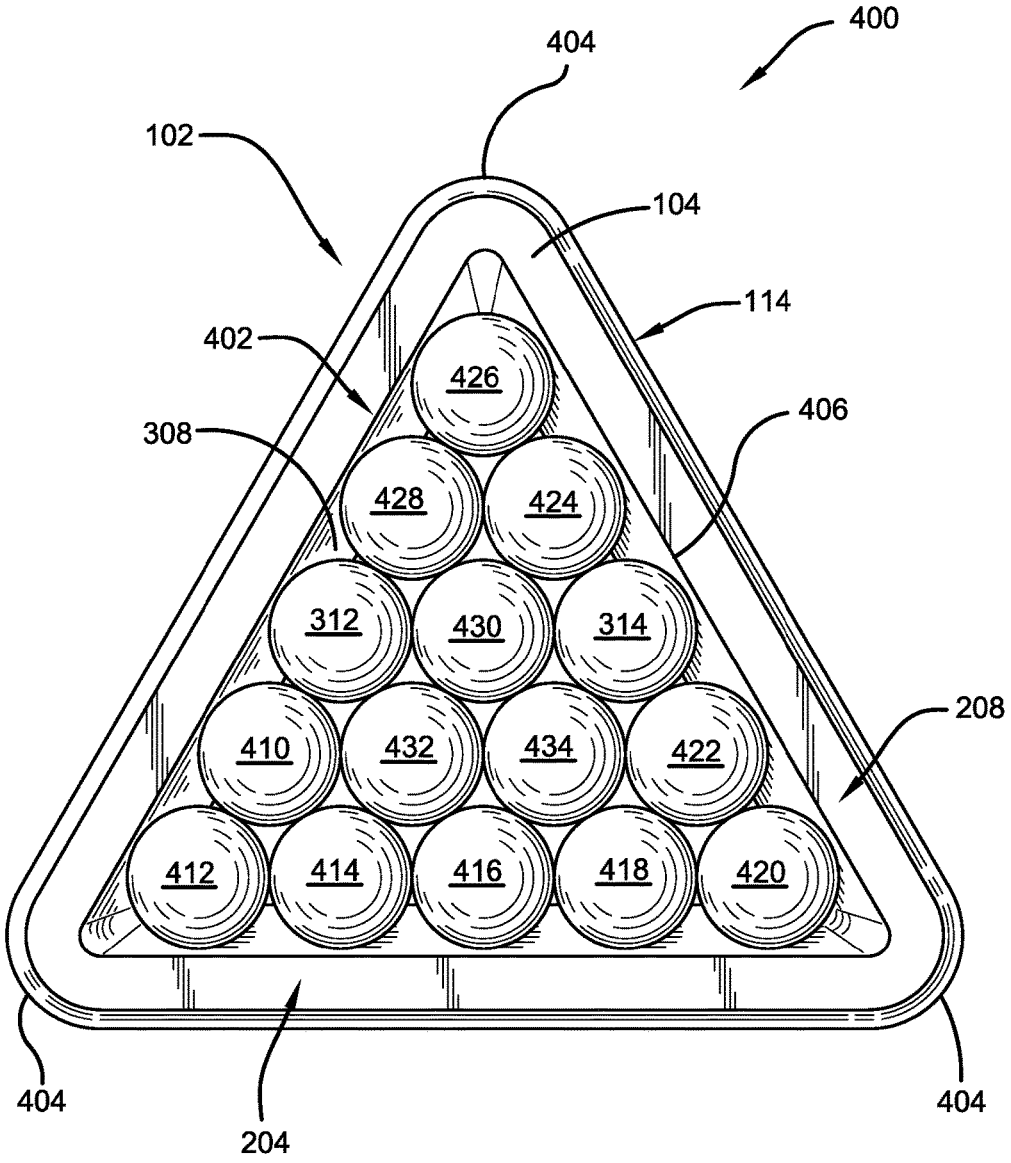
FIG. 4 is a bottom plan view of the billiard rack.

FIG. 4 illustrates a bottom view 400 of the example billiard rack 102 that is resting on the set of billiard balls 204. It should be noted that in this example, the billiard rack is operative to rack a set of fifteen billiard balls in a generally triangular arrangement 402. As used herein the wording "generally triangular" or "substantially triangular" corresponds to an arrangement or shape that has three sides in the form of a triangle, whether or not the sides of the arrangement or shape are perfectly straight or the corners are perfectly sharp. For example, as shown in FIG. 4, the generally triangular arrangement 402 of the set of billiard balls overall has three sides in the shape of an equilateral triangle, even though the edges of such a triangle include curved portions from the curvature of the balls on the peripheral of the set of billiard balls.

Also, as shown in FIG. 4, the outer circumferential side wall 114 of the frame 104, has a generally triangular shape that includes rounded corners 404, rather than pointed corners. In addition, the inner edge 406 of the bottom side of the frame 104, also has a generally triangular shape which may include the substantially straight sides and pointed tips of a traditional triangle as shown in FIG. 4.

It should be understood that as used herein, the term "generally" or "substantially" as modifiers for a particularly named geometric shape corresponds to the particularly named shape and corresponding shapes that overall have a visual appearance that is closer to the named shape (e.g., a triangle shape) than a geometric shape with a different number of sides (e.g., a square shape or a pentagon shape).

As shown in FIG. 4, the peripheral balls of the set of fifteen billiard balls 204, correspond to the twelve billiard balls that make up the three sides of the triangular arrangement. Thus, the peripheral balls are billiard balls 410, 412, 414, 416, 418, 420, 422, 424, 426, 428 and balls 312 and 314 previously shown in FIG. 3. Also, in this example, the interior billiard balls (i.e., non-peripheral balls) are billiard balls 430, 432, and 434.

As discussed previously, the cam surface 308 is configured to contact all of the peripheral balls when the billiard rack 102 is placed on the set of fifteen billiard balls 204. By acting on all of the peripheral balls, the tapered configuration of the cam surface 308 urges the complete set of billiard balls together such that each billiard ball is in contact with at least two neighboring billiard balls. Further as shown in FIG. 4, most of the billiard balls will be urged by the forces from the cam surface to be in contact with 4-6 neighboring billiard balls. It should be understood, that neighboring balls refer to those billiard balls that are adjacent thereto. Thus, billiard ball 424 is a neighboring ball to billiard ball 430, but, billiard ball 426 is not a neighboring ball to billiard ball 430.

As used herein the term peripheral billiard balls refers to those billiard balls at the peripheral of the set of billiard balls being racked by the billiard rack. Also as used herein, the term interior billiard balls refers to those billiard balls in the interior of the set of billiard balls that are surrounded by the peripheral billiard balls. Also, as will be shown in more detail below, in some arrangements of billiard balls in the billiard racks described herein, there may be no interior billiard balls. Rather the set of billiard balls may be tightly racked with just peripheral billiard balls in contact with each other and the cam surface of the billiard rack.

With a perfect set of billiard balls (i.e., where all of the billiard balls have the same diameter and are perfectly spherical), the example rack would simultaneously place each billiard ball in contact with all of its neighboring billiard balls in the set of billiard balls. However, it should be noted that some billiard balls in a set may not be identical in terms of size and shape. A small variation in the diameters or curvature of one or more of the billiard balls may result in a small gap between some neighboring balls. For example, if the interior ball 430 were to have a slightly smaller diameter than the other balls in the set, interior ball 430 may be in contact with 5 neighboring billiard balls rather than all six neighboring balls 428, 424, 312, 314, 432, 438.

In addition, it should be appreciated that one or more balls may have a diameter that significantly varies from the others. With reference to FIG. 3, because the top side 108 of the frame 104 includes an upper opening 302 to the set of balls, such oversized and undersized billiard balls may be visible through the upper opening 302. A user may pull the incorrectly sized ball from the set (through the upper opening 302) and replace it with a properly sized billiard ball.

In addition, because the example embodiment of the billiard rack is operative to tightly compact uniformly sized balls together, even non-visible gaps adjacent improperly sized balls may be detectable by placing a hand through the upper opening 302 and attempting to rotate the billiard balls. In general, billiard balls that are operative to freely rotate in the billiard rack (i.e., are operative to rotate with less force) compared to other billiard balls, may have an improper size as well (and thus can be detected and replaced in the set of billiard balls through the upper opening 302). Thus, example embodiments of the described billiard rack may serve as a gauge to uncover improperly sized balls in a set of billiard balls. Also, it should be appreciated that the upper opening 302 also enables a user to lift up and reposition billiard balls in the set of billiard balls to place numbered and/or colored or differently marked balls in a different order (depending on the rules of the particular billiard game being played.)

Figure 5:
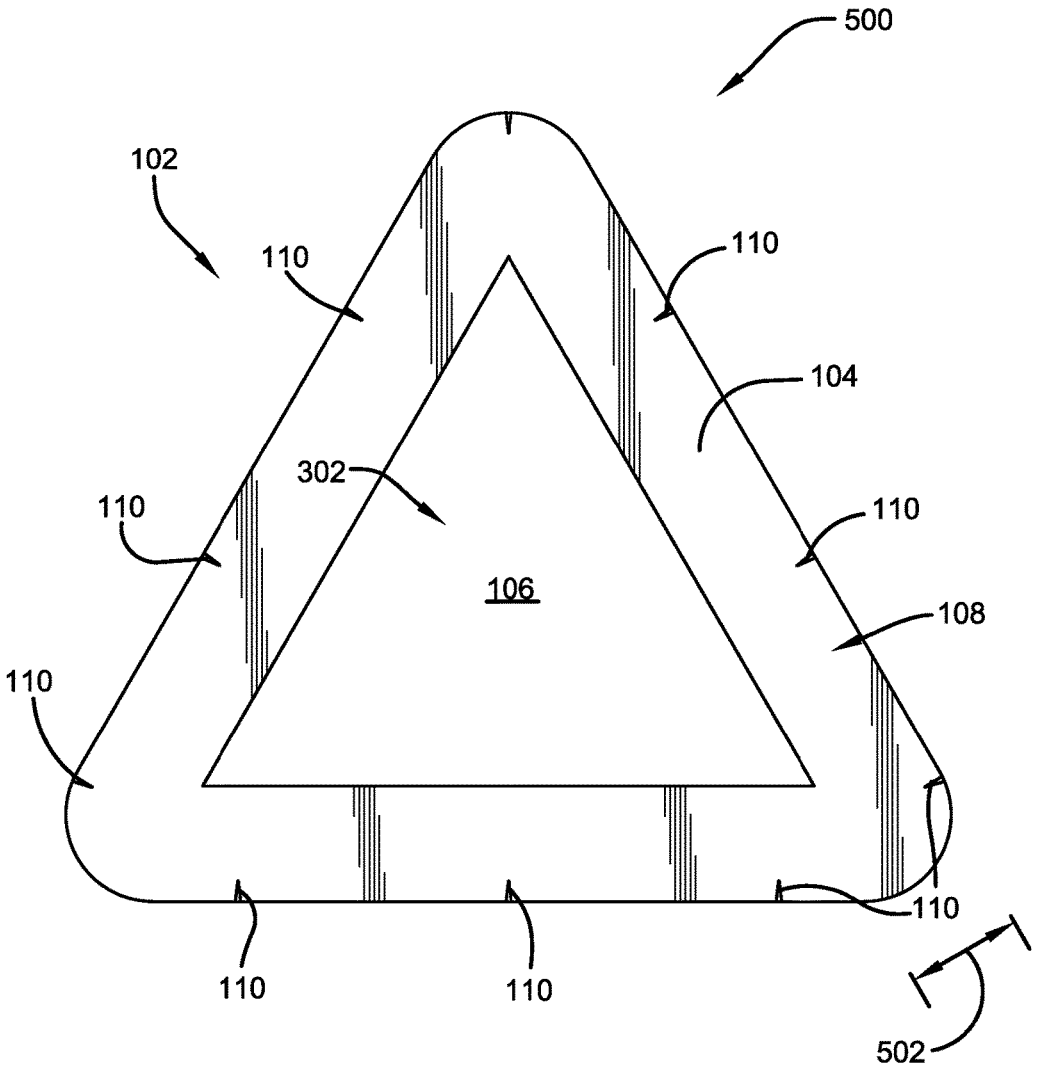
FIG. 5 is a top plan view of the billiard rack without billiard balls.
Figure 6:
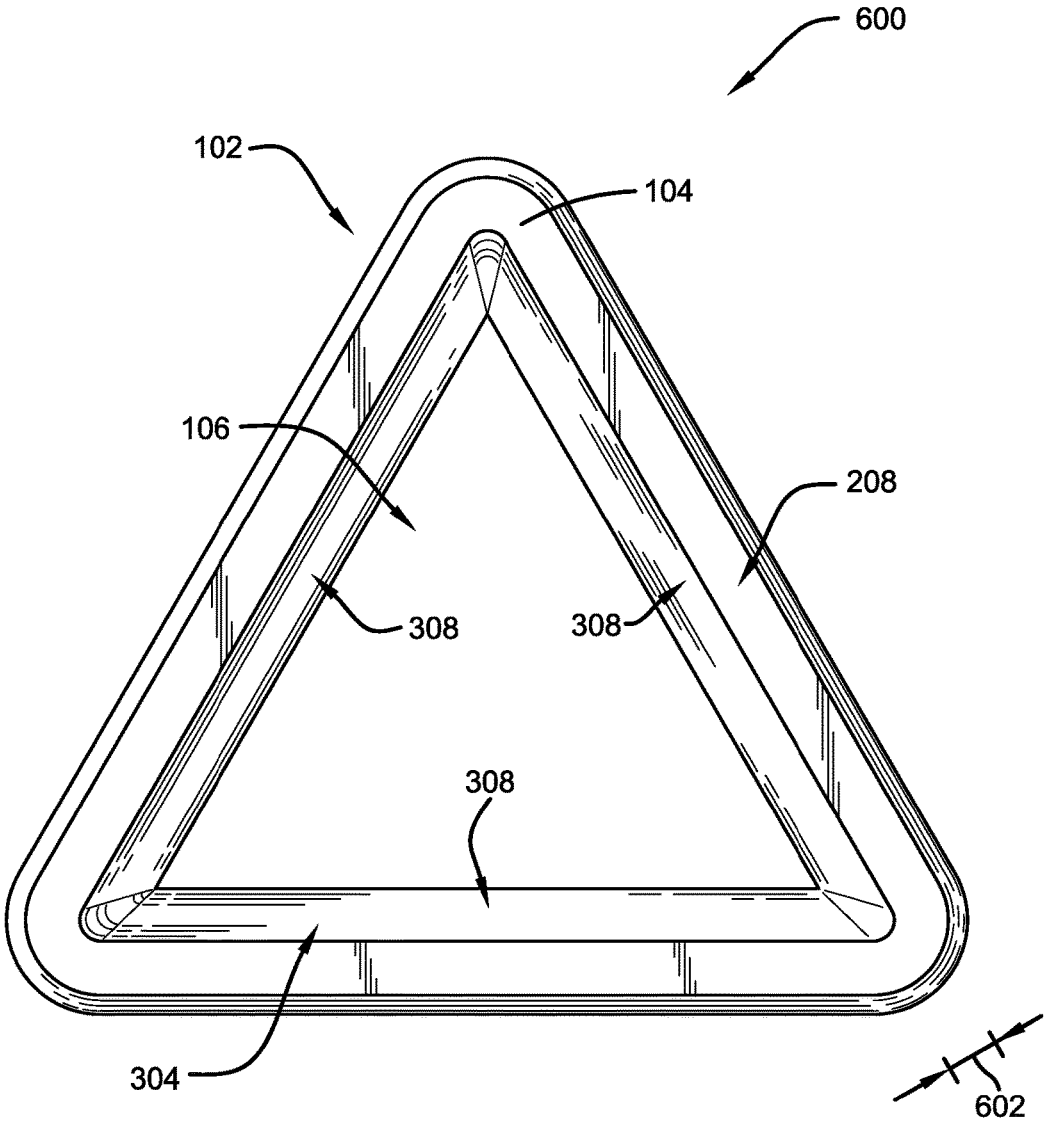
FIG. 6 is a bottom plan view of the billiard rack without billiard balls.
Figure 7:
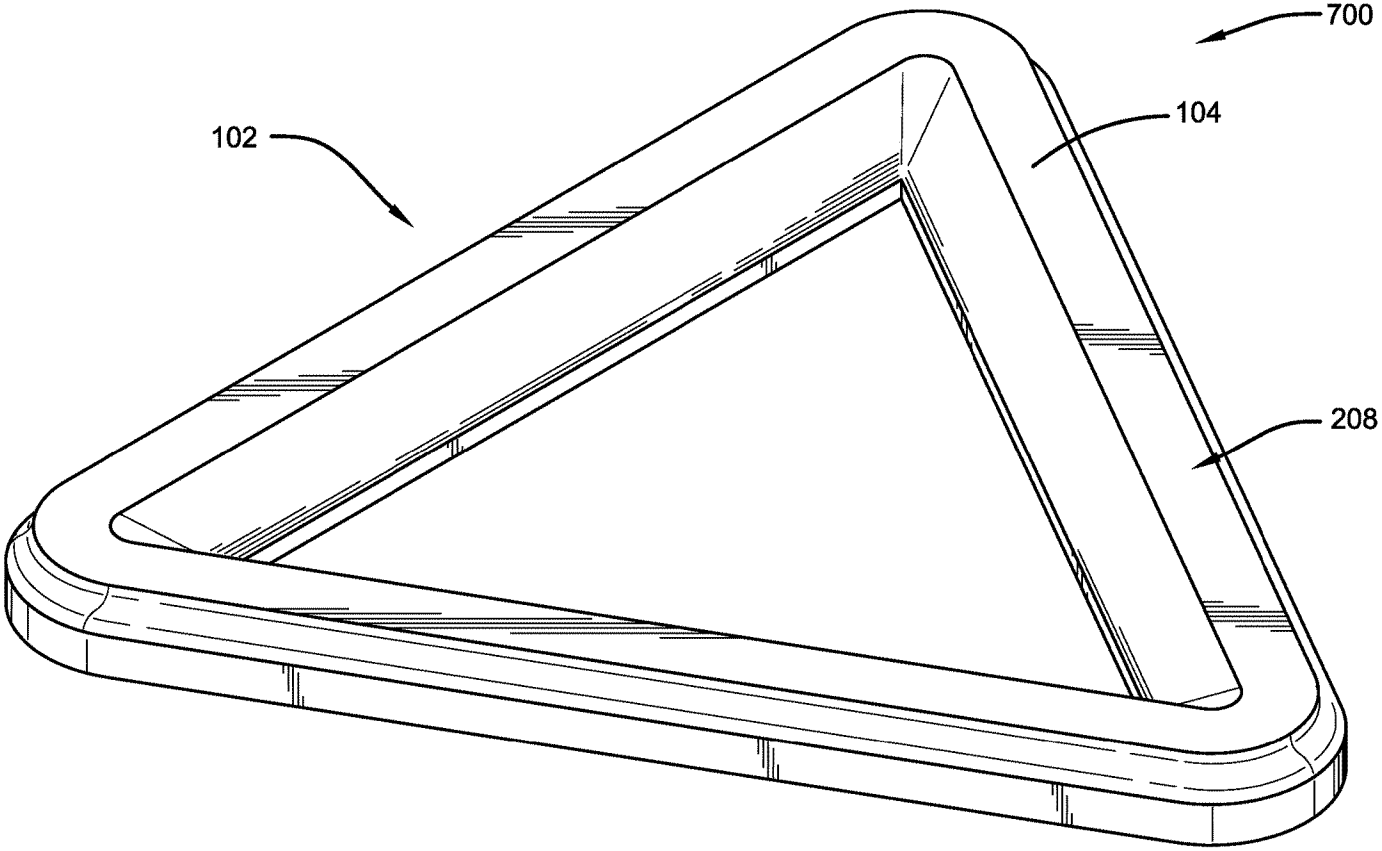
FIG. 7 is a perspective view of the billiard rack without billiard balls.

In order to further illustrate the example configuration of the billiard rack 102, FIG. 5 shows a top plan view 500 of the frame 104; FIG. 6, shows a bottom plan view 600 of the frame 104; and FIG. 7 shows a side perspective view 700 of the frame 104.

Also as shown in FIG. 3, it should be appreciated that the cam surface 308 may have a cross-sectional width 318 (via a plane that is perpendicular to both the cam surface and the top/bottom sides) of between 0.5 inches (12.7 mm) and 1.5 inches (38.1 mm) (such as about one inch or 25.4 mm). Such a relatively wide taper enables the billiard rack to capture and gather in a set of billiard balls that is resting on the bed of a billiard table, but may not be in a uniform triangular arrangement.

Figure 8:
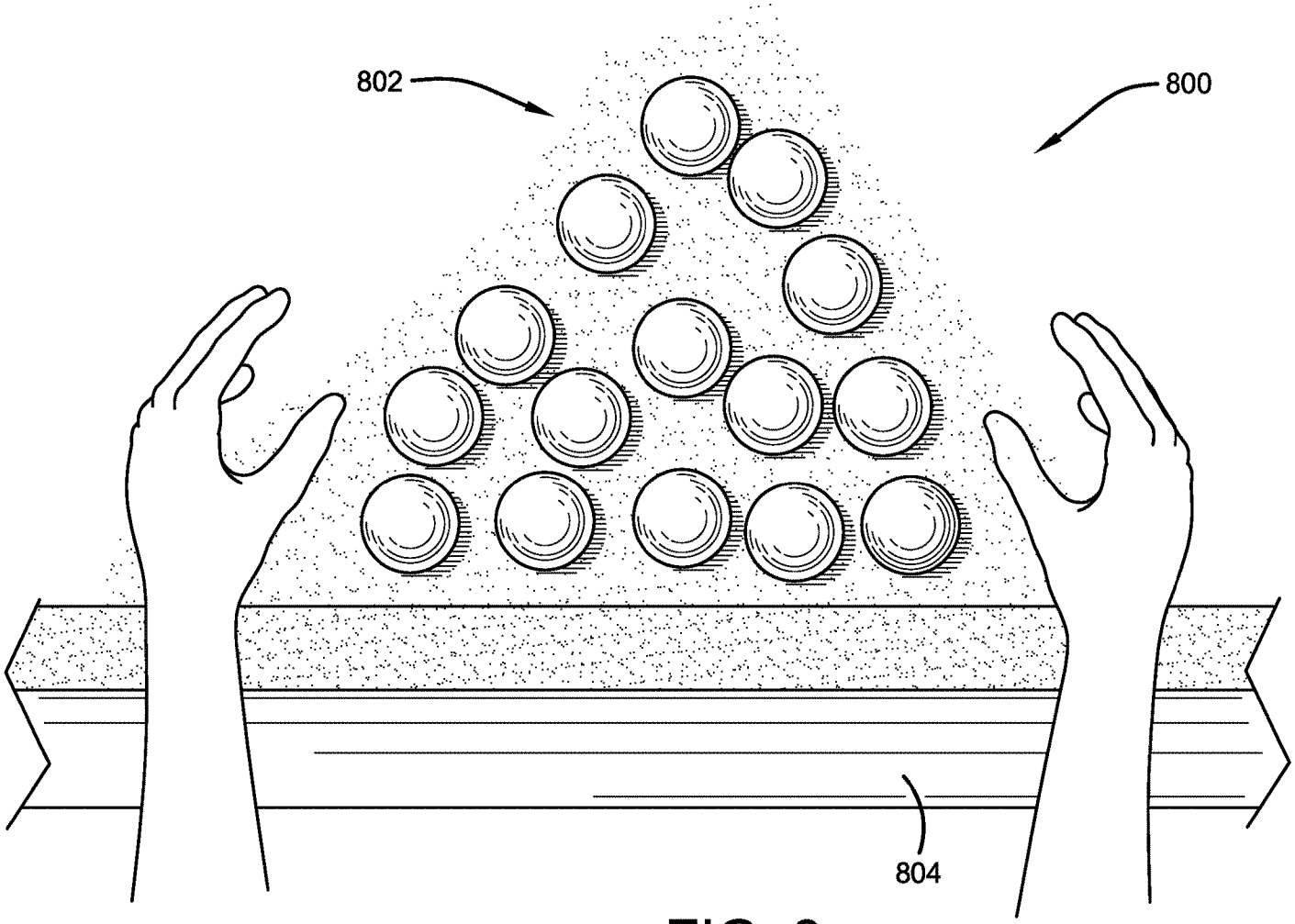
FIG. 8 shows an example method of gathering a set of billiard balls.

For example, as illustrated in FIG. 8, one method 800 of using the described billiard rack may include a user pushing a set of fifteen billiard balls 802 together with their hands into a generally triangular shape adjacent the cushion/rail 804 of a billiard table. It should be appreciated that such a process will leave many gaps between neighboring balls, and the overall shape of the set of balls will be larger than the triangular shape of the set of balls that are tightly racked together. However, even with this relatively wider spacing of the balls, the relatively wide taper of the cam surface (such as shown in FIG. 3) may be operative to contact the spaced apart billiard balls and urge them together.

Also, in cases where one or more balls are still outside the perimeter of the cam surface, the relatively wide bottom side 208 (see FIG. 3) of the frame 104 of the rack is operative to press down on such outward balls and keep them from rolling away from the triangular arrangement. For example, as shown in FIG. 6, the thickness of the bottom side 208 (in a radial direction) from the opening may be at least 0.5 inches (12.7 mm) (such as 1 inch or 24.5 mm). The user may then use their fingers to push any such outward balls further inwardly so as to be positioned to contact the cam surface as the frame is moved downwardly around the complete set of fifteen billiard balls.

As shown in FIG. 6, the cam surface continuously extends around the portions of the interior space 106 that are adjacent the lower opening 304. However, it should be appreciated that in alternative embodiments, the described cam surface may correspond to a plurality of spaced apart cam surfaces along the inside wall of the frame. For example, the cam surfaces may not extend to the corners of the generally triangularly shaped interior space 106. Thus, the cam surface may be broken up into three cam surfaces (one for each side of the generally triangularly shaped interior space 106).

Also, as shown in FIG. 3, the cam surface does not extend all the way to the top surface 108 of the frame. However, it should be appreciated that in alternative embodiments, the cam surface may extend to the top surface. Also, as shown in FIG. 3, the cam surface may extend all the way to the bottom side 208 of the frame. However, in alternative embodiments the cam surface may not extend all the way to the bottom side 208 of the frame.

As shown in FIG. 3 the tapered surface may be generally flat and may be orientated at an angle 316 at about 45 degrees with respect to the plane that includes the generally flat bottom side 208 of the frame. However, it should be appreciated that in alternative embodiments, the cam surface may extend at other acute angles (e.g., between 30 degrees and 60 degrees). Also, the cam surface may extend at a plurality of different angles (such as between 30 and 60 degrees) between the bottom side and the top side of the frame. For example, in alternative embodiments the cam surface may have a rounded surface which may be concave and or convex in cross-section.

In example embodiments, the frame is made out of a single piece of a plastic material such as ABS, PVC, polyester, polypropylene, or any other type of plastic. Also, the frame may be made out of wood, aluminum, or other materials that are sufficiently durable to enable the billiard rack to be used thousands of times to rack billiard balls. In addition, it should be appreciated that the billiard rack may be made out of a plurality of different materials. For example, the majority of the body of the frame may be made out of a hard plastic such as ABS; however, interior surfaces that form the cam surface may be made out of or may be covered by a flexible resilient material such as a rubber, felt, foam, cloth, and/or other material that is operative to compress in order to compensate for possible variations in the diameters of billiard balls in the set of billiard balls being racked.

With reference to FIGS. 5 and 6, it should be appreciated that the tapered cam surface of the frame results in a relatively larger generally triangular shaped lower opening 304 on the bottom side 208 of the frame (See FIG. 6) compared to the generally triangular shaped upper opening 302 on the top side 108 of the frame (See FIG. 5). As a result, the minimum radial thickness 502 of the top side of the frame that surrounds the upper opening 302 is larger than the corresponding minimum radial thickness 602 on the bottom side of the frame. For example, in this described embodiment, the minimum radial thickness 502 of the top side of the frame may be at least 1 inch (25.4 mm) (such as 2 1/16 inches or 52.4 mm).

As shown in FIG. 7, the bottom side 208 may be substantially planar (i.e., flat) and may be oriented parallel to the substantially planar top side 108. In this context the wording of substantially flat or substantially planar corresponds to a surface that is perfectly flat or deviates from flat no more than 2 mm above or below the average planar position of the surface. For example, such a substantially flat surface may include an embossed surface pattern or texture with a depth of less than 2 mm and would still be considered to be substantially/generally planar or substantially/generally flat.

When the billiard rack is placed on the cloth bed of a billiard table, it should be appreciated that the bottom side may compress portions of the cloth on the bed of the billiard table which is visibly noticeable when the billiard rack is lifted off of the table. In example embodiments, random embossed patterns and textures may be formed on the bottom side 208 to minimize the visual appearance of such compressed portions of the cloth. In addition, it should be appreciated that in alternative embodiments, the top side of the rack may have other contours such as a rounded surface, a tapered surface, a conical surface, or any other surface configuration that does not interfere with the arrangement of the billiard balls described herein.

As illustrated in FIG. 2, the frame 104 includes an outer side wall 114 that has a circumferential outer side surface 210 that extends between the top side 108 and bottom side 207 of the frame. This outer side surface 210 may include a beveled portion 212 having a channel that extends inwardly and that has a depth that is operative to receive tips of human fingers therein. Such a beveled portion facilitates grasping and lifting of the frame off of the set of billiard balls 204. However, it should be appreciated that alternative embodiments may include other features that facilitate grasping and lifting of the billiard rack off of a set of billiard balls. For example, in an alternative embodiment, the outer side walls may taper inwardly in directions from the top side to the bottom side of the frame in order to provide a surface that enables easier grasping and lifting of the frame. Also, in alternative embodiments, the outer side walls may include handles attached thereto.

It should also be appreciated that the described billiard rack may have further shapes and configurations that are consistent with the functionality described herein with respect to a frame having a cam surface that is set on a set of billiard balls. For example, an alternative embodiment of the described frame may not include an upper opening in the top side of the frame or alternatively, the upper opening may not have a shape that matches the outer shape of the frame or the lower opening. For example, the upper opening may have a generally circular shape.

Figure 9:
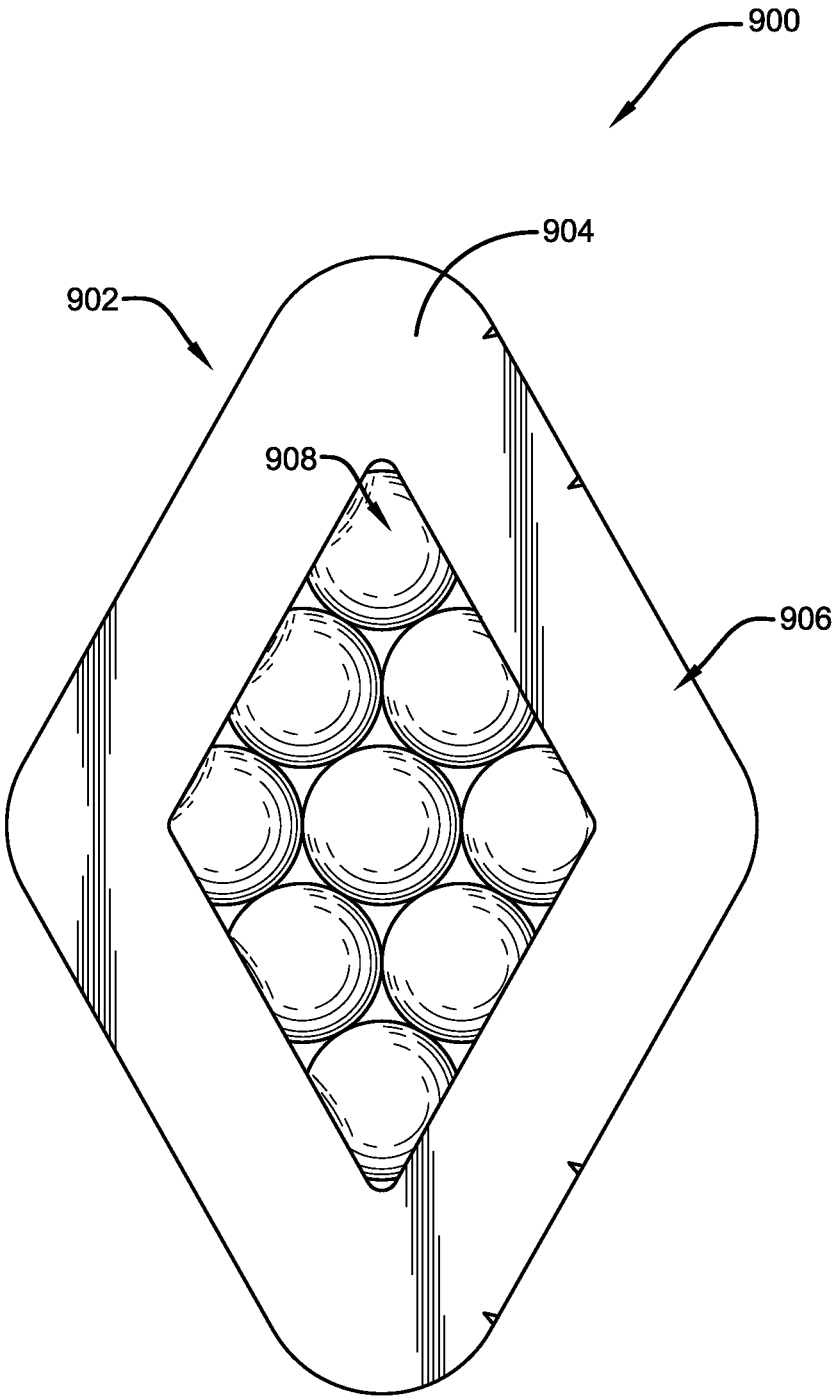
FIG. 9 is a top plan view of an alternative billiard rack that facilitates racking a set of nine billiard balls in a generally non-square rhombus shape.
Figure 10:
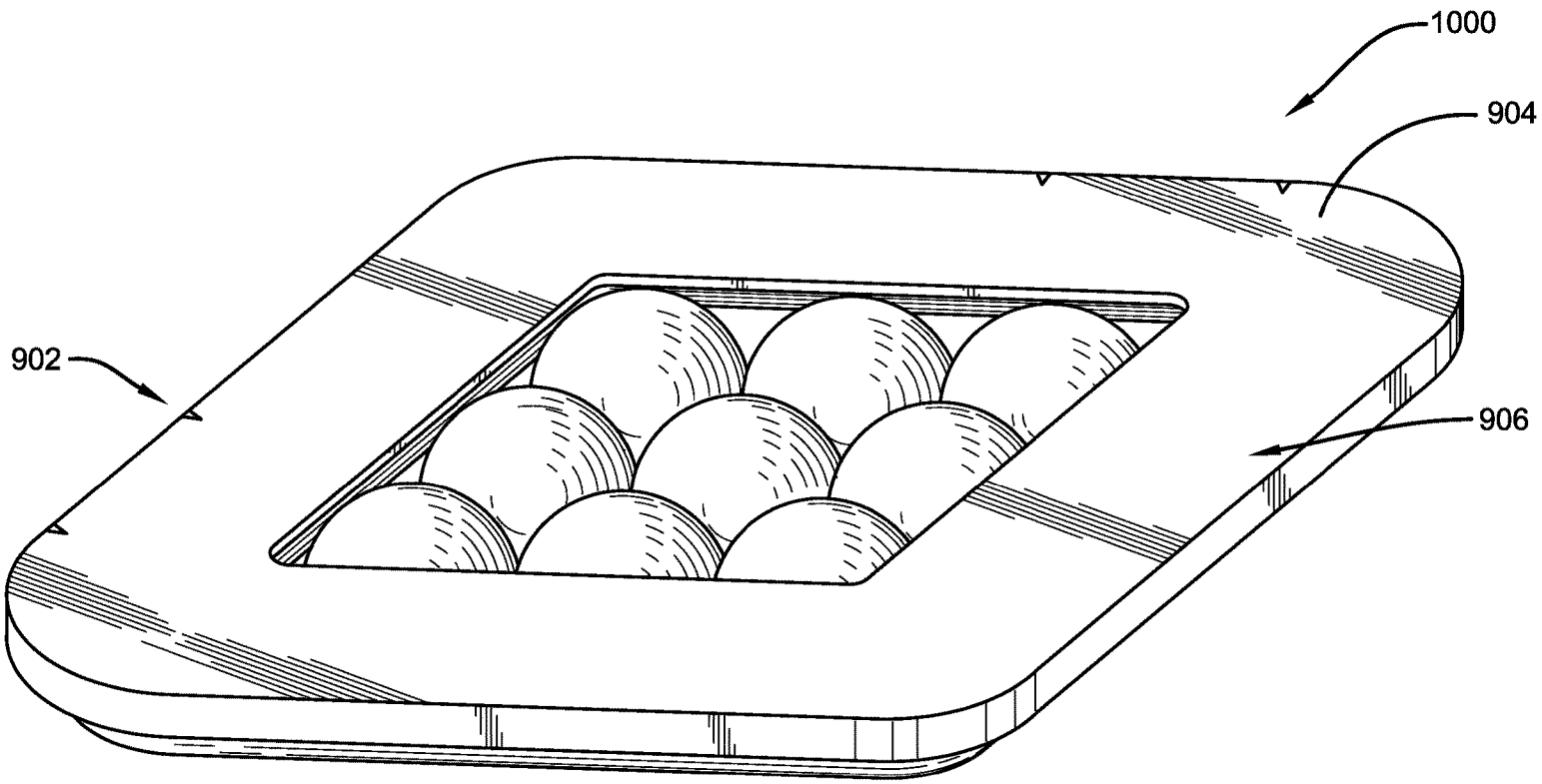
FIG. 10 is a front right side perspective view of the alternative billiard rack placed on a set of nine billiard balls.
Figure 11:
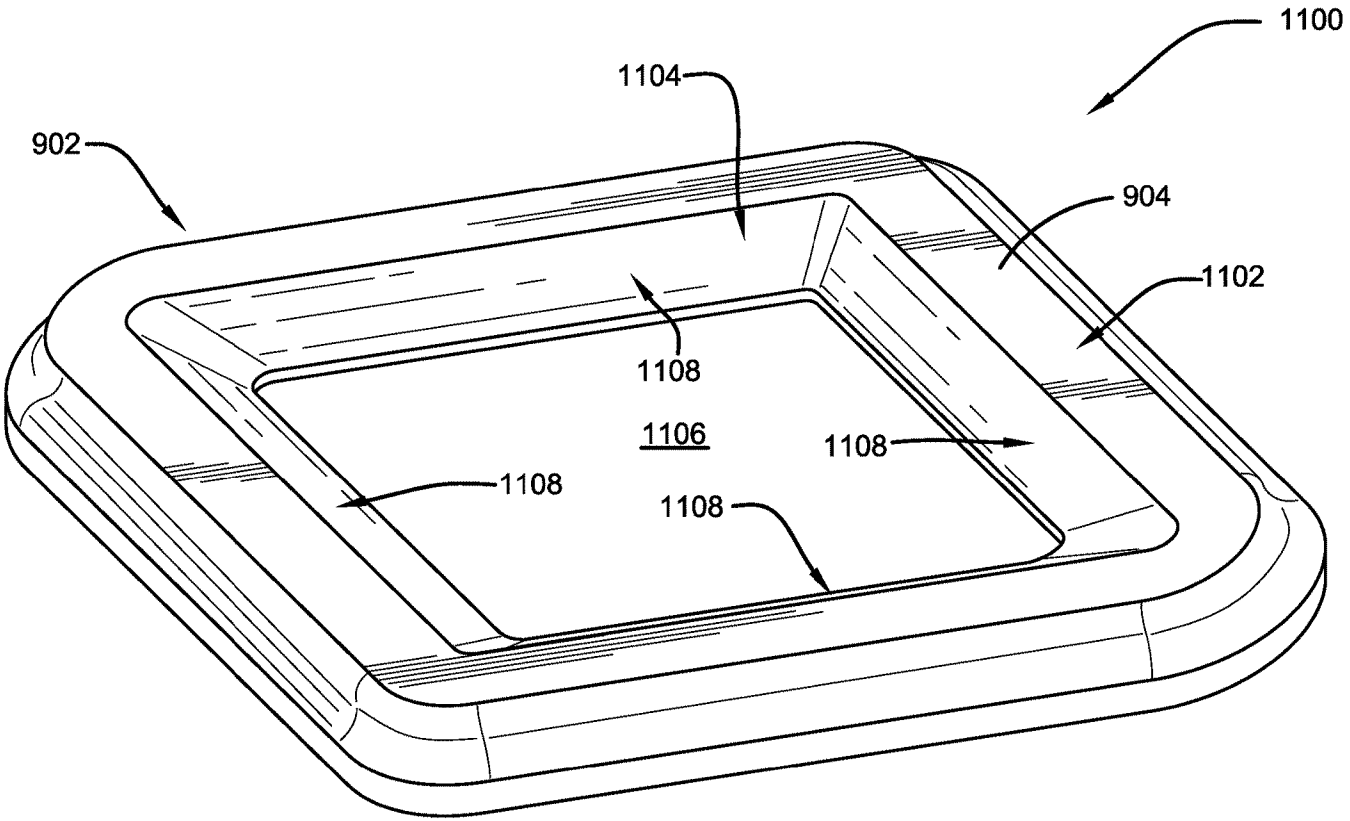
FIG. 11 is a bottom right side perspective view of the alternative billiard rack without billiard balls.
Figure 12:
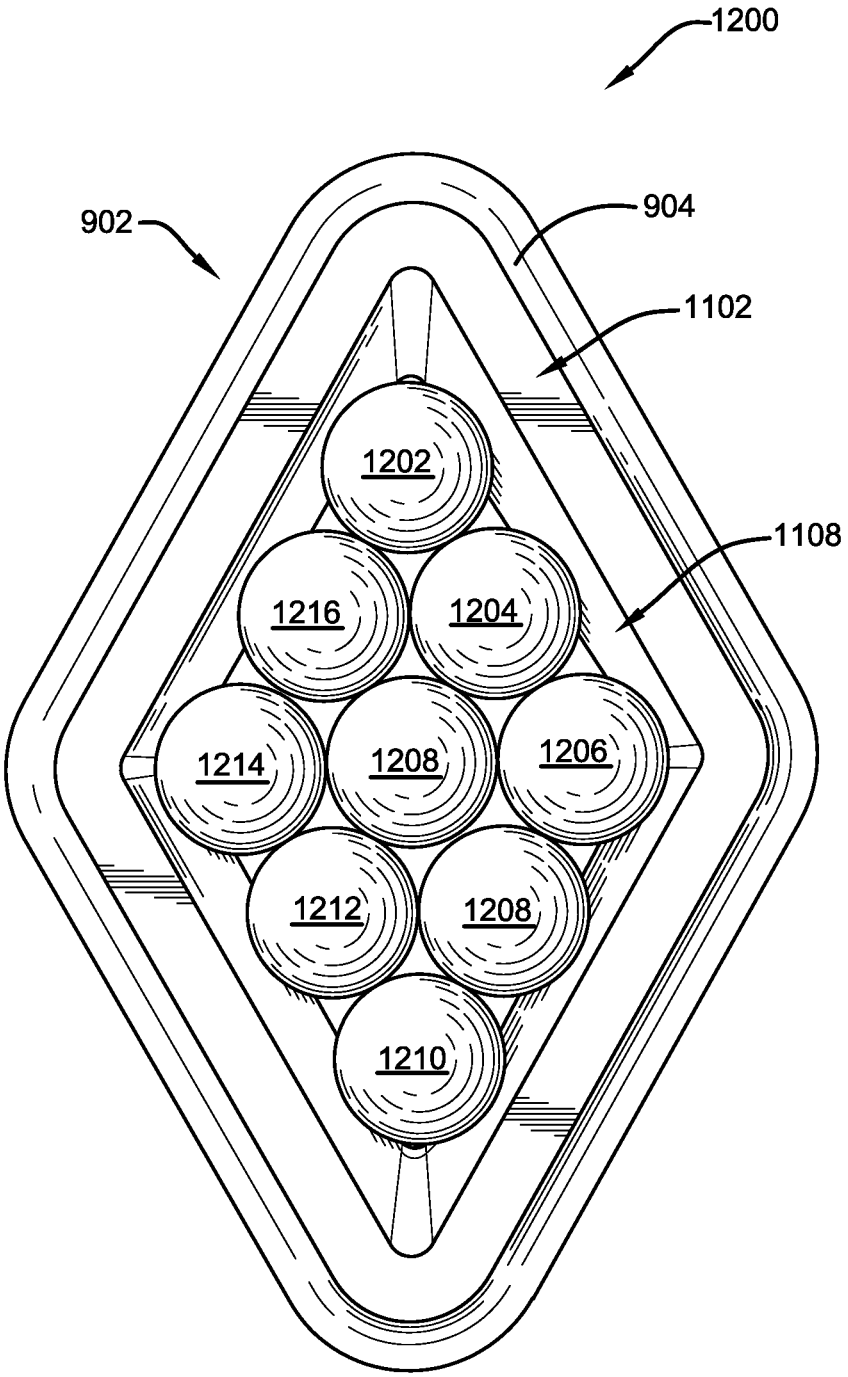
FIG. 12 is a bottom plan view of the alternative billiard rack with nine billiard balls.

In addition, it should be appreciated that the shape of the billiard rack may be adapted to accommodate different numbers of balls and different arrangements of balls for a set of billiard balls. For example, FIG. 9 shows a top plan view 900 of a billiard rack 902 that comprises a frame 904 having a generally non-square rhombus shape. FIG. 10 illustrates a top side perspective view 1000 of the billiard rack 902 that is resting and has racked a set of nine billiard balls. Also FIG. 11 illustrates a bottom side perspective view 1100 of the billiard rack 902. In addition, FIG. 12 illustrates a bottom view 1200 of the billiard rack 902 showing the arrangement of the nine billiard balls that is produced by the billiard rack.

As shown in FIG. 9, the frame 904 includes a top side 906 that includes an upper opening 908 into the interior area of the frame. As shown in FIG. 11, the frame 904 has a bottom side 1102 that includes a lower opening 1104 to an interior space 1106 that has a generally non-square rhombus shape. The lower portions of the interior space are bounded by at least one cam surface 1108. As shown in FIG. 12, this interior space of the frame has a shape that receives a set of nine billiard balls extending into the lower opening in a general non-square rhombus arrangement. The cam surface 1108 is configured to contact all eight of the peripheral billiard balls (1202-1216) of the set of nine peripheral billiard balls and urge the set of nine billiard balls together, such that each billiard ball is in contact with at least two neighboring billiard balls in the general non-square rhombus arrangement. In this example, the weight of the frame 904 may be greater than 0.75 pounds (0.34 kg), for example such as about 1.0 pounds (0.45 kg).

Figure 13:
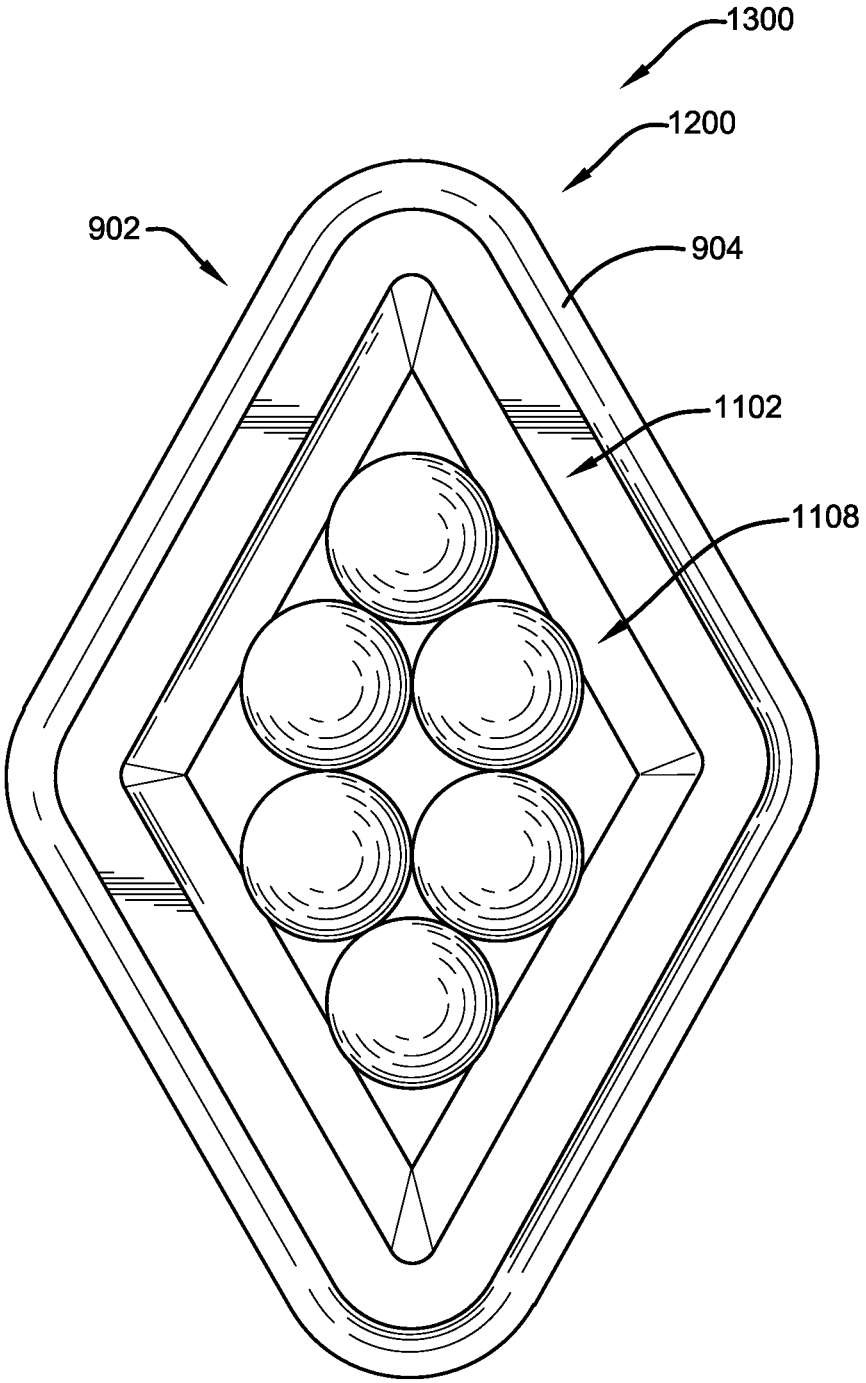
FIG. 13 is a bottom plan view of the alternative billiard rack with 6 billiard balls.

In addition, it should be appreciated that the same billiard rack may be adapted to accommodate racking different numbers of balls and different arrangements of balls. For example, FIG. 13 shows a bottom view of the same billiard rack 902 which is resting on and has tightly racked a set of six billiard balls in the manner described previously with respect to a set of nine billiard balls.

In addition, it should be appreciated that the configuration of the described billiard rack frames may be operative to tightly rack many different arrangements of billiard balls, including arrangements in which one or more peripheral or interior billiard balls are removed from the set of billiard balls being racked. For example, FIGS. 29A-K show examples of top views of the generally triangularly shaped rack 102 being used to tightly rack several different arrangements of billiard balls with the number of billiard balls ranging from fifteen to nine. Also, as shown in FIGS. 29 L-N, the example billiard rack may also rack an even smaller number by placing a set of three or five billiard balls in a generally triangular arrangement against the cushion rail 804 of the billiard table and using the billiard rack (at an acute angle to the bed of the billiard rack) to tightly compact the billiard balls against the rail. As shown in FIGS. 29 L and N, the billiard rack could be arranged with the top side 108 up or the bottom side 208 up in order to rack a set of three billiard balls against the cushion rail 804.

However, it should be noted that when the cushion rail 804 is used, the angled orientation of the rack/cam surface may result in billiard balls adjacent to the rack being spaced apart. An example of this spaced apart arrangement produced by the billiard rack is illustrated in FIG. 29 L in which the top side of the billiard rack faces upwardly.

In a similar manner, FIGS. 30A-H show examples of the top views of the generally non-square rhombus shaped rack 902 being used to tightly rack several different arrangements of billiard balls with the number of billiard balls ranging from nine to four. Also, as shown in FIGS. 30 I and J, the example billiard rack may also rack an even smaller number by placing a set of three billiard balls in a generally triangular arrangement against the cushion rail 804 of the billiard table and using the billiard rack (at an acute angle to the bed of the billiard rack) to tightly compact the billiard balls against the rail. It should also be appreciated that the billiard rack 902 could be flipped over with its top side facing down, in order to rack a set of billiard balls against the cushion rail in a similar manner to that shown in FIGS. 30 I and J.

Figure 14:
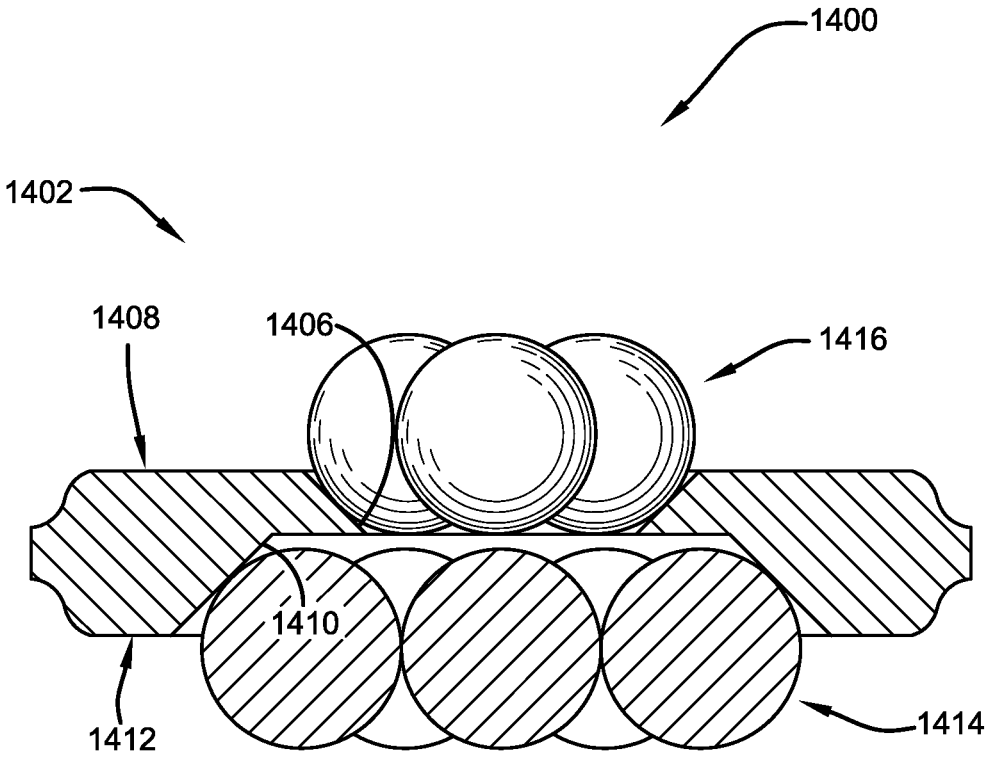
FIG. 14 is a cross-sectional view of another alternative embodiment of a billiard rack.

In the examples of the billiard racks described above, the billiard frames include a cam surface adjacent to a bottom side of the frames. However, it should be appreciated that in alternative embodiments the upper side of the rack may include an addition cam surface that is configured to tightly rack a lesser number of billiard balls than the cam surface adjacent the bottom side of the frame. FIG. 14 illustrates a cross-sectional view 1400 of a further rack 1402 that is a variation of the non-square rhombus shaped billiard rack 902 of FIG. 9. In this example the rack 1402 has a frame 1404 with an additional cam surface 1406 adjacent the top side 1408 that is positioned inwardly of the cam surface 1410 adjacent the bottom side 1412 of the frame. Thus, this alternative example would be operable to tightly rack both a set of nine billiard balls 1414 and a set of six billiard balls 1416 (by flipping the rack over).

Figure 15:
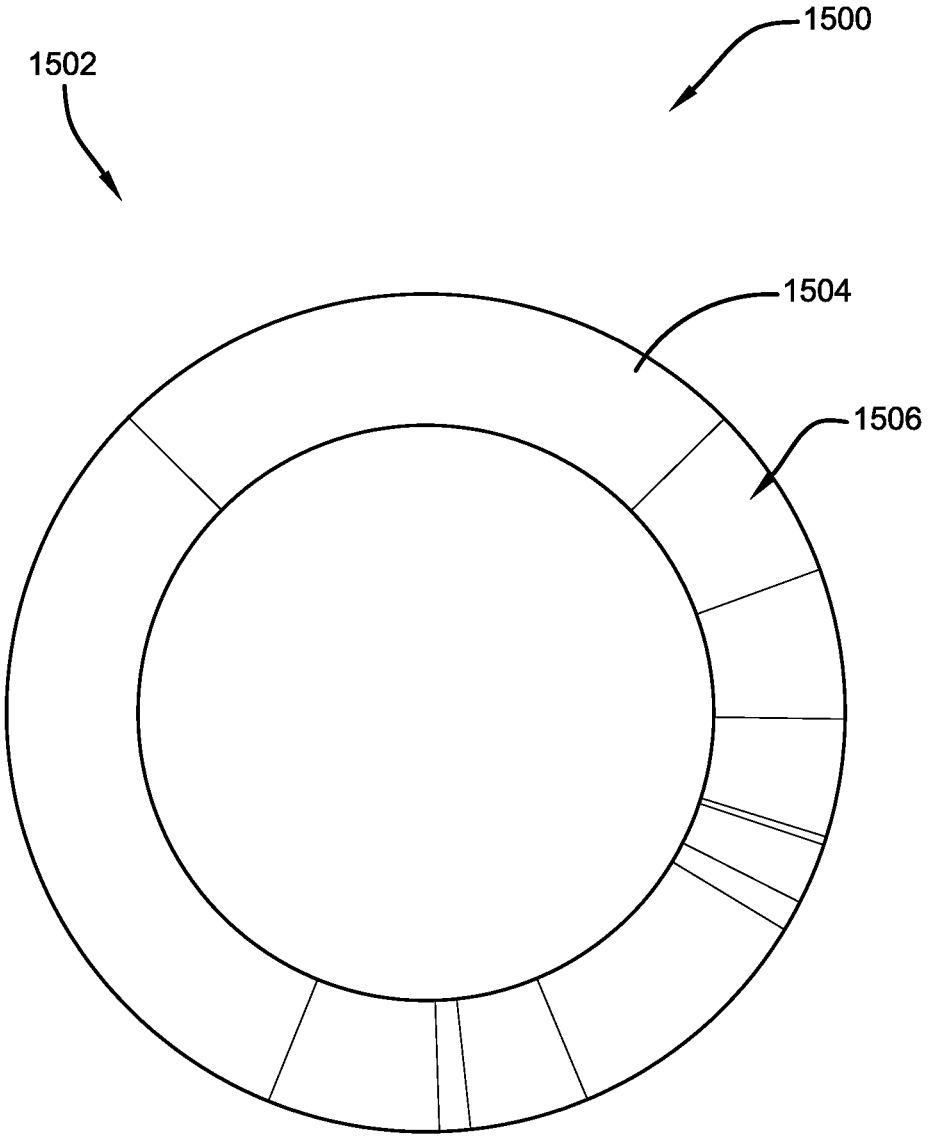
FIG. 15 is top plan view of a further alternative billiard rack having a generally circular shape.
Figure 16:
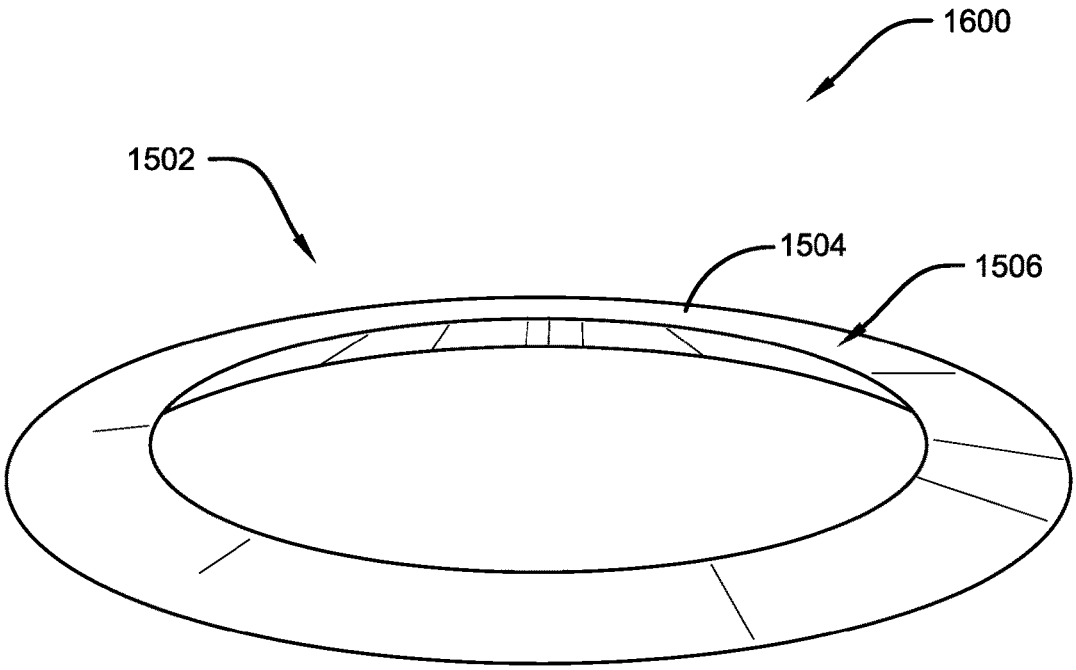
FIG. 16 is a top perspective view of the billiard rack without billiard balls.
Figure 17:
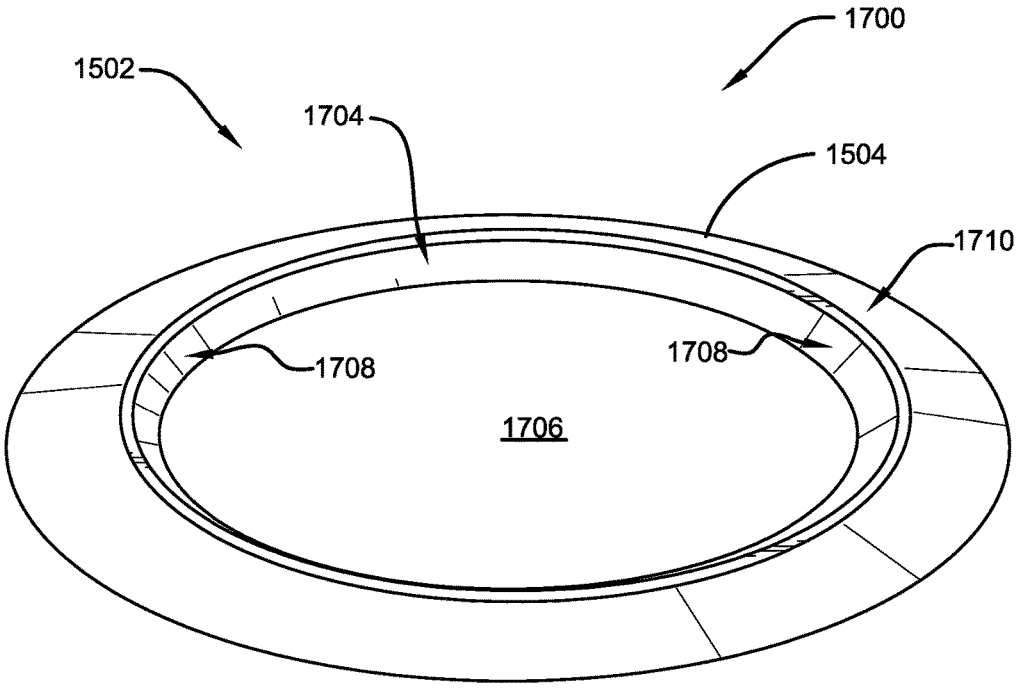
FIG. 17 is a bottom perspective view of the billiard rack without billiard balls.
Figure 18:
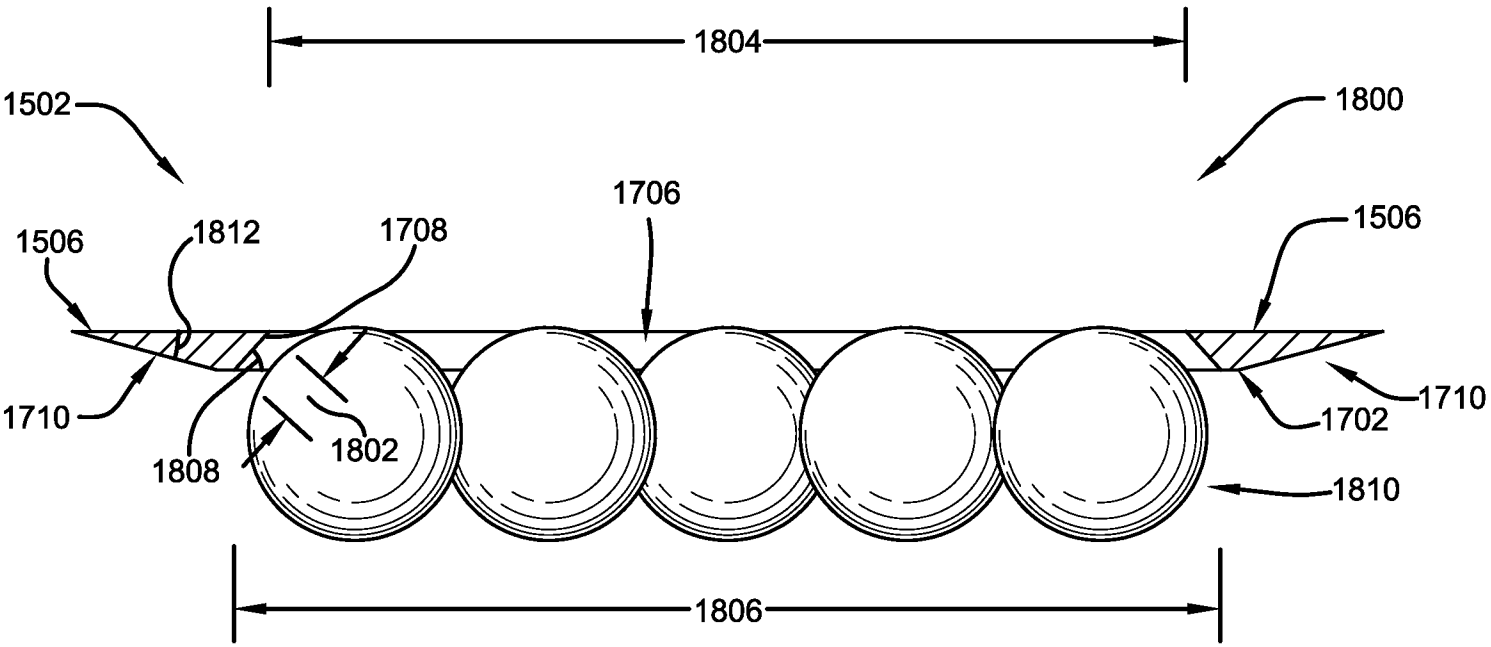
FIG. 18 is a cross-sectional view of the circular billiard rack.

FIG. 15 shows a top plan view 1500 of another example of a billiard rack 1502. In this example, the frame 1504 has a circular shape. FIG. 16 illustrates a top side perspective view 1600 of the circular billiard rack 1502 and FIG. 17 illustrates a bottom side perspective view 1700 of the circular billiard rack 1502. Also FIG. 18 illustrates a side cross-sectional view 1800 of the billiard rack that is placed on and has racked a set of billiard balls 1810.

As shown in FIG. 17, the frame 1504 has a bottom side 1702 that includes a lower opening 1704 to an interior space 1706 that has a circular shape. The lower portions of the interior space are bounded by at least one cam surface 1708. As shown in FIG. 18, the cam surface 1708 may have a tapered angle 1808 between 30 and 60 degrees (such as about 45 degrees) relative to the plane that includes the bottom side 1702. Also the cam surface may have a cross-sectional width 1802 (via a plane that is perpendicular to both the cam surface and the bottom/top sides) that is between ⅜ inch (0.9525 cm) and ¾ inch (1.905 cm), such as about 0.5 inches (1.27 cm).

Referring to FIG. 17, it should be noted that in this example, the frame may also include an outer tapered surface 1710 that tapers radially outwardly in a direction from the bottom side 1702 to the top side 1506 shown in FIG. 15. As shown in FIG. 18, such an outer tapered surface 1710 may have an acute angle 1812 between 10 and 45 degrees (such as about 15 degrees) relative to the generally flat top side 1506 that is smaller than the acute angle 1808 of the tapered cam surface.

Figure 19:
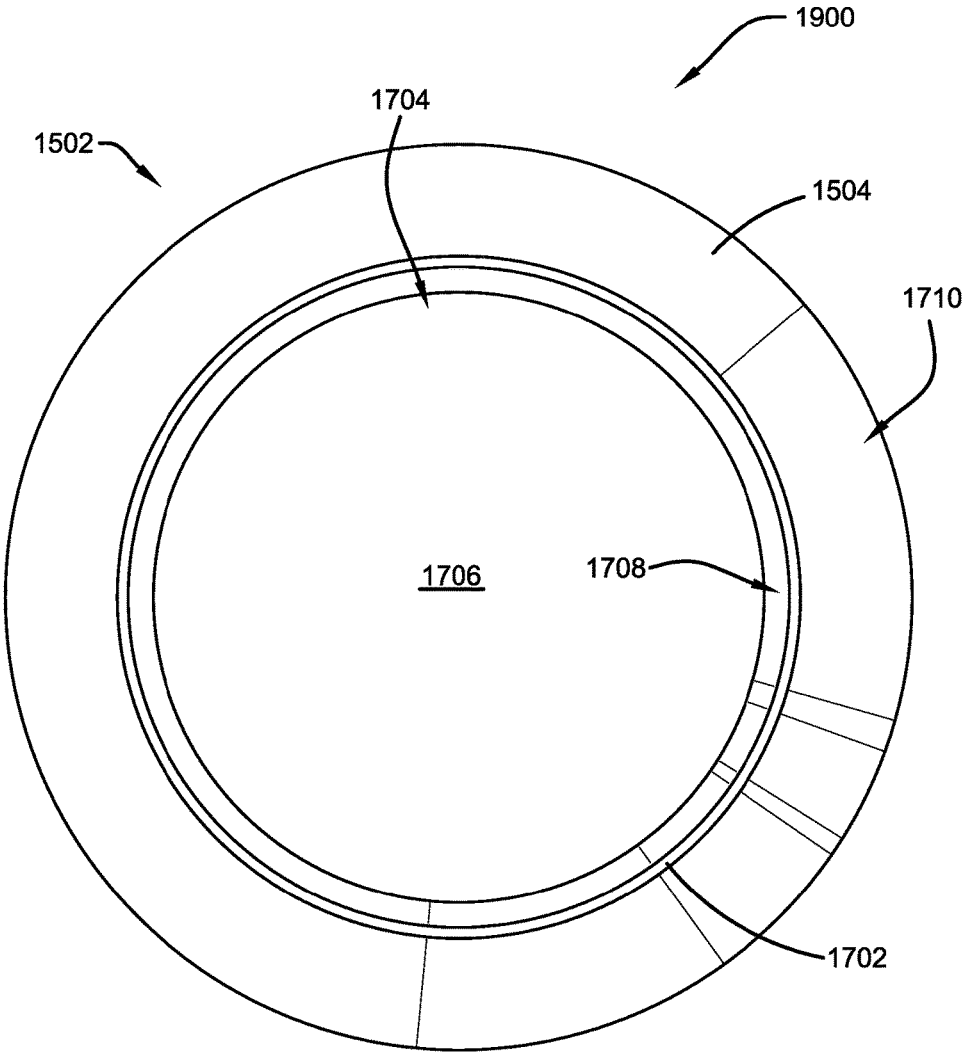
FIG. 19 is a bottom plan view of the circular billiard rack without billiard balls.
Figure 20:
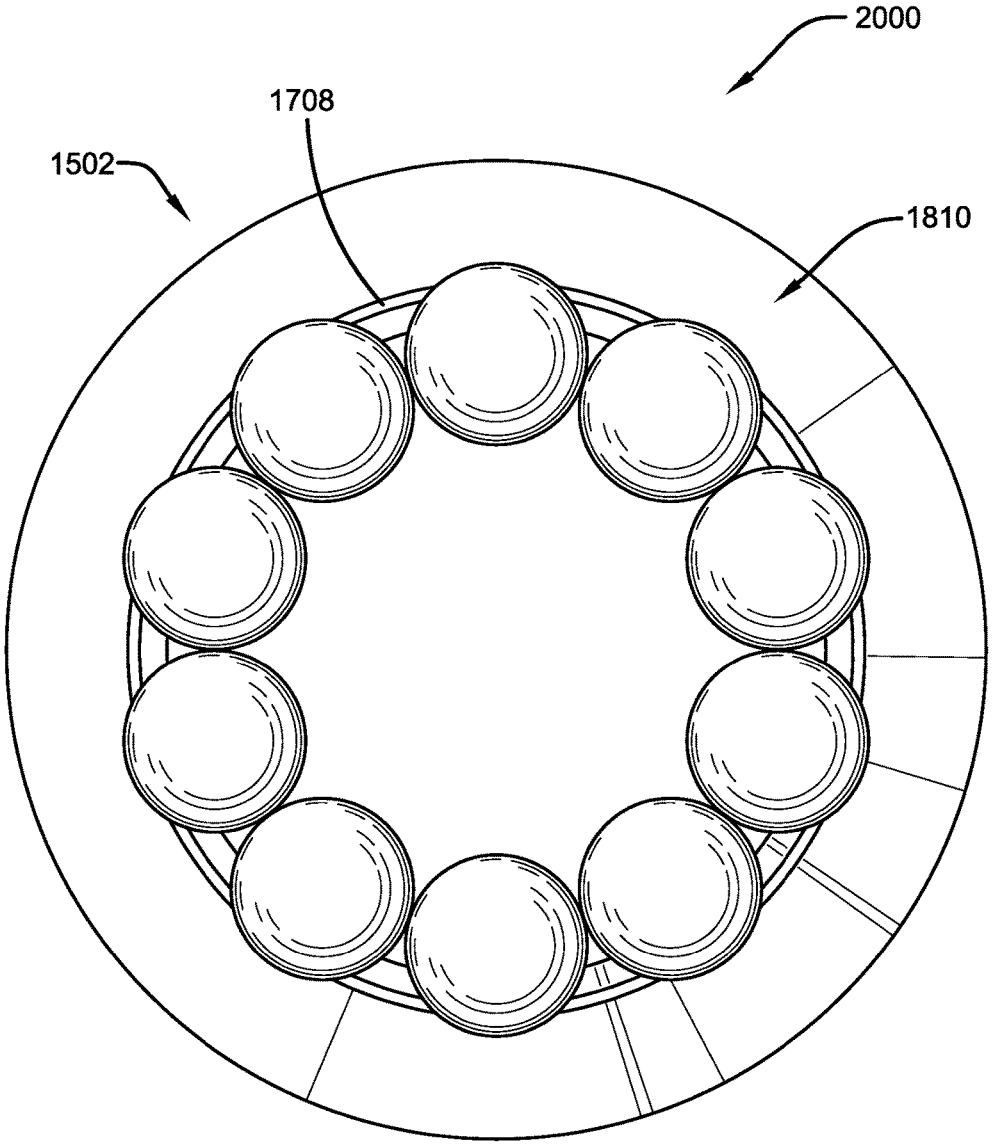
FIG. 20 is a bottom plan view of the circular billiard rack with a first set of billiard balls.

FIG. 19 illustrates a bottom plan view of the circular billiard rack 1502 without any balls. FIG. 20 illustrates a bottom plan view 2000 of the circular billiard rack 1502 that has been placed on top of and has racked the set of billiard balls 1810. As shown in FIG. 20, the interior space of the frame has a size that may receive a set of ten billiard balls 1810 extending into the lower opening in a ring shape arrangement. In this example, all of the ten billiard balls correspond to peripheral billiard balls without any interior billiard balls. The cam surface 1708 is configured to contact all of the ten peripheral billiard balls and urge the set of ten billiard balls together, such that each billiard ball is in contact with two neighboring peripheral billiard balls in the ring shape arrangement.

It should also be appreciated that for a particular game of billiards, additional billiard balls may be placed inside the tightly racked ring of ten billiard balls. For example, additional billiard balls may be placed in the ring of ten billiard balls either before or after the circular billiard rack 1502 is removed from being in contact with the ring of ten billiard balls.

Figure 21:
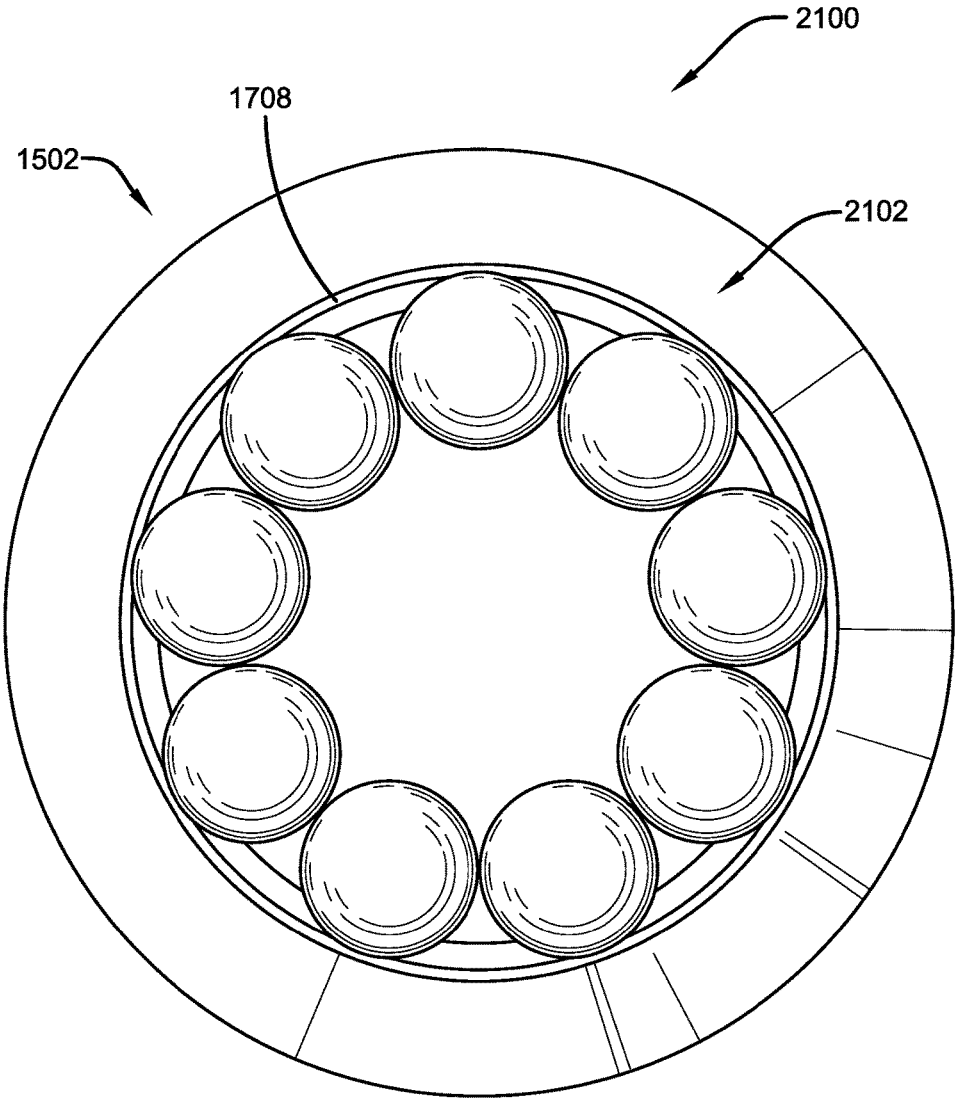
FIG. 21 is a bottom plan view of the circular billiard rack with a second set of billiard balls.

In addition, it should be noted that the cross-sectional width 1802 of the cam surface 1708 may be sufficient to rack a different number of billiard balls in a ring shape arrangement. For example, FIG. 21 illustrates a bottom plan view 2100 of the circular billiard rack 1502 that has been placed on top of and has racked a set of a different number of billiard balls 2102. As shown in FIG. 21, the interior space of the frame has a size that may receive a set of nine billiard balls 2102 extending into the lower opening in a ring shape arrangement. In this example, all of the nine billiard balls correspond to peripheral billiard balls without any interior billiard balls. The cam surface 1708 is configured to contact all of the nine peripheral billiard balls and urge the set of nine billiard balls together, such that each billiard ball is in contact with two neighboring peripheral billiard balls in the ring shape arrangement.

Referring back to FIG. 18, from the above examples, it should be appreciated that the inner diameter 2304 and outer diameter 2306 of the cam surface 1708 may be sufficiently wide to rack a plurality of different numbers of billiard balls in a ring shaped arrangement (e.g. ten balls or nine balls or other number of billiard balls). For example, to accommodate racking nine or ten billiard balls in a ring in the manner described above, the inner diameter 1804 may be about 8 and 3/16 inches (20.80 cm) and the outer diameter 1806 may be about 8 and 9/16 inches (21.74 cm). However, it should be appreciated that the inner and outer diameters may be different than these dimensions depending on the diameters of the billiard balls and/or the desired overall size of the billiard rack in order to rack one or more different numbers of billiard balls in a generally ring shaped arrangement.

Figure 22:
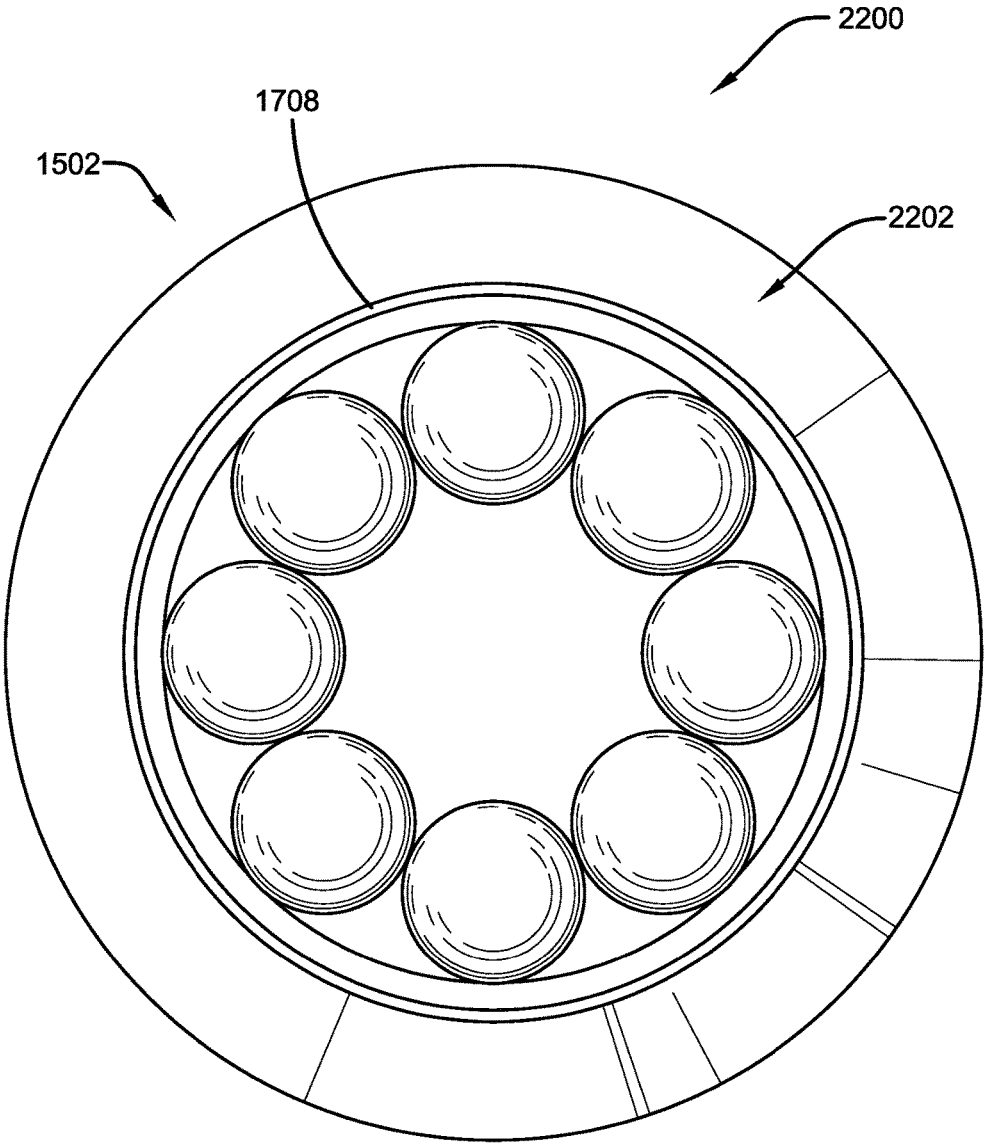
FIG. 22 is a bottom plan view of the circular billiard rack with a third set of billiard balls.

Further, it should be noted that the cross-sectional width 1802 of the cam surface 1708 may be sufficient to rack an even smaller number of billiard balls in a ring shape arrangement without resting on the billiard balls. For example, FIG. 22 illustrates a bottom plan view 2200 of the circular billiard rack 1502 that has been placed around an even smaller set of billiard balls 2102. As shown in FIG. 22, the interior space of the frame has a size that may receive a set of eight billiard balls 2202 extending into the lower opening in a ring shape arrangement. However, unlike the previous examples with respect to sets of ten or nine billiards balls, the inner diameter of the cam surface has a size that is operative to contact the eight billiard balls in a tightly assembled ring without resting on the billiard balls.

Figure 23:
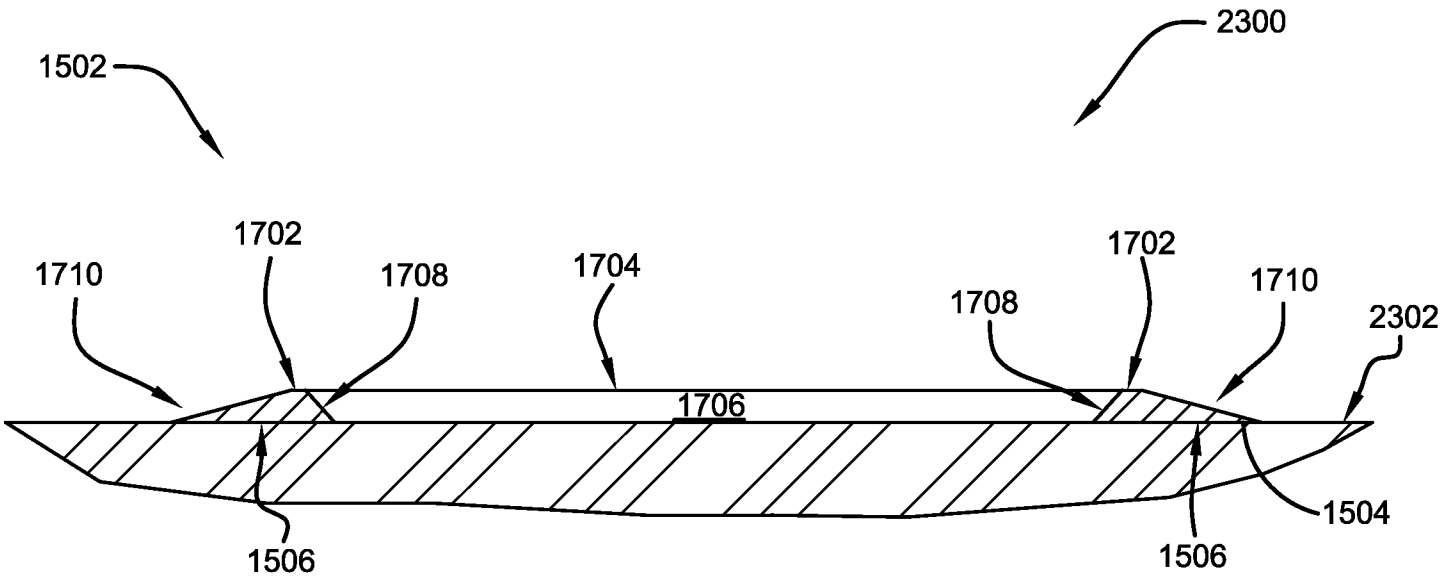
FIG. 23 is a cross-sectional view of the circular billiard rack flipped upside down.

In an example embodiment, the circular billiard rack 1502 may also serve as a game piece when flipped over as illustrated in the cross-sectional view 2300 of FIG. 23. When flipped over, the frame 1504 may be placed upside down with the top side 1506 resting on the bed 2302 of a billiard table. Billiard games may then be played in which billiard balls are shot so as to roll up the outer tapered surface and land in the interior area 1706.

Figure 24:
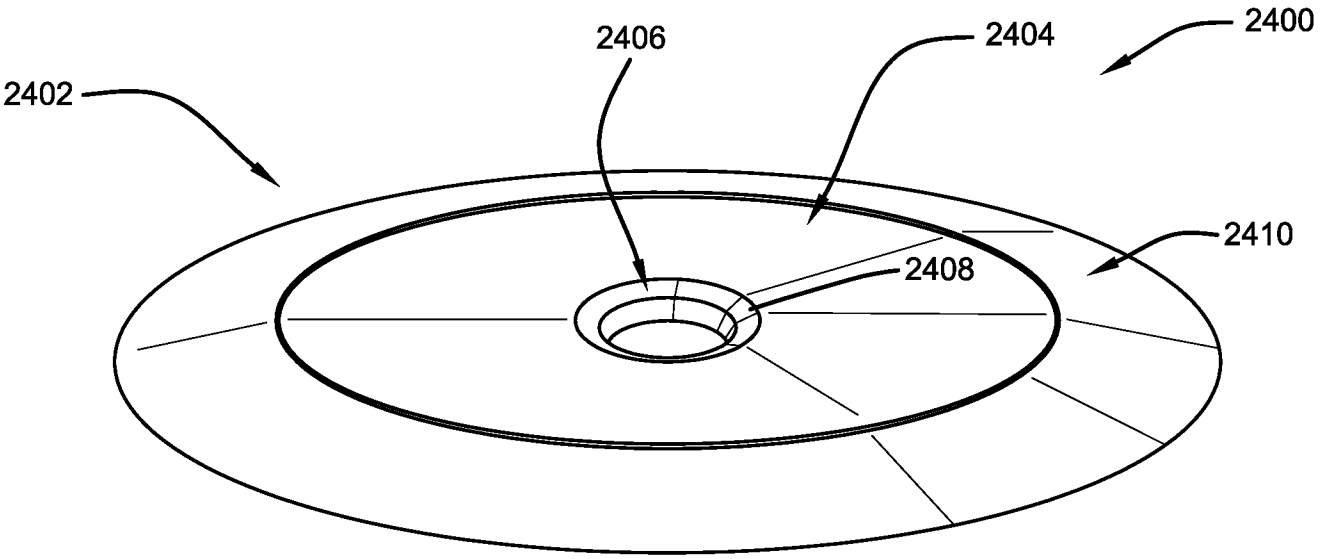
FIG. 24 is a top perspective view of a game piece disc.
Figure 25:
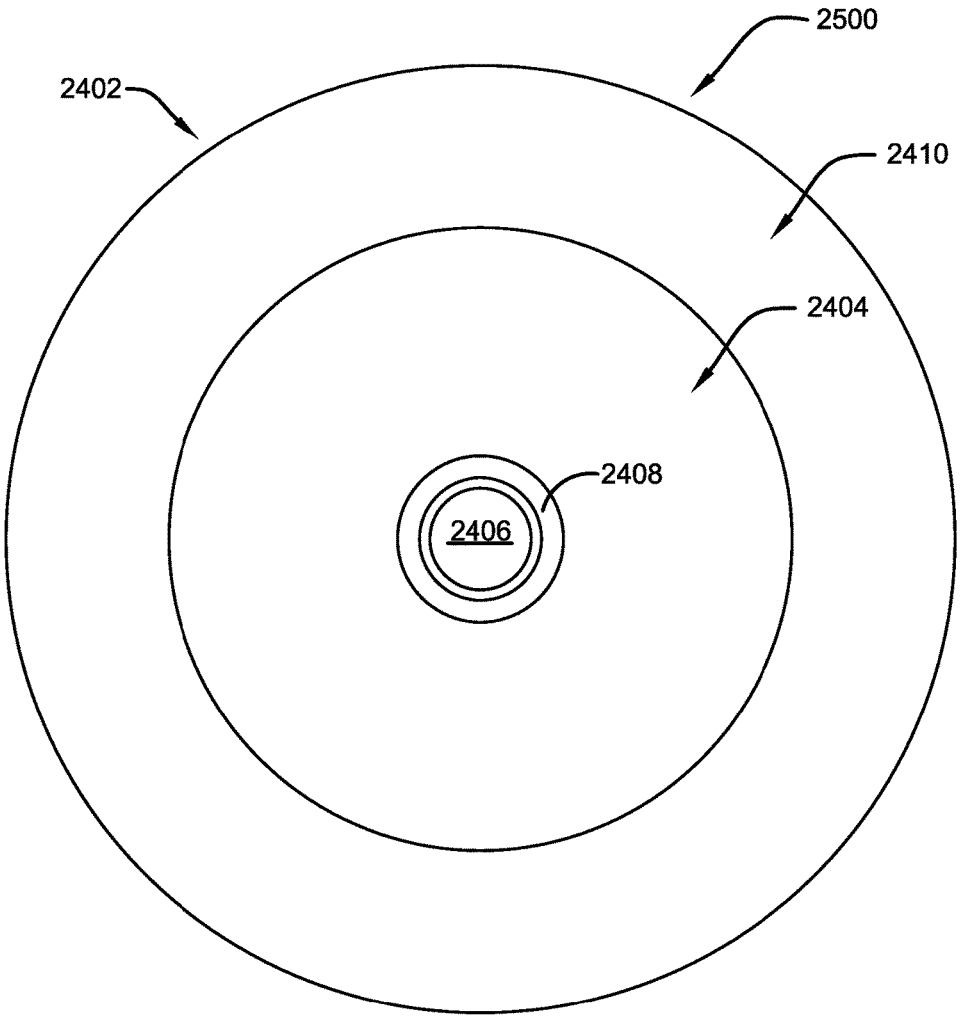
FIG. 25 is a top plan view of the game piece disc.

Referring now to FIG. 24, a top side perspective view 2400 of an example of a circular game piece disc 2402 that may be used in combination with the circular billiard rack 1502 is illustrated. Also FIG. 25 illustrates a top side perspective view 2500 of the game piece disc 2402 and FIG. 26 illustrates a side perspective view 2600 of the game piece disc 2402.

As shown in FIG. 24, the game piece disc 2402 may have a top side 2404 that includes a central circular opening 2406. Such an opening may include a circumferential edge 2408 that tapers downwardly toward the center of the opening. In this example, the inner diameter of the central circular opening 2406 is less than the diameter of a billiard ball. As shown in FIG. 26, the tapered edge 2408 may be orientated at an angle (e.g., about 45 degrees or other angle between 30-60 degrees), such that when a billiard ball 2608 is placed on the center circular opening 2406, the billiard ball will rest on the tapered edge 2408.

Figure 26:
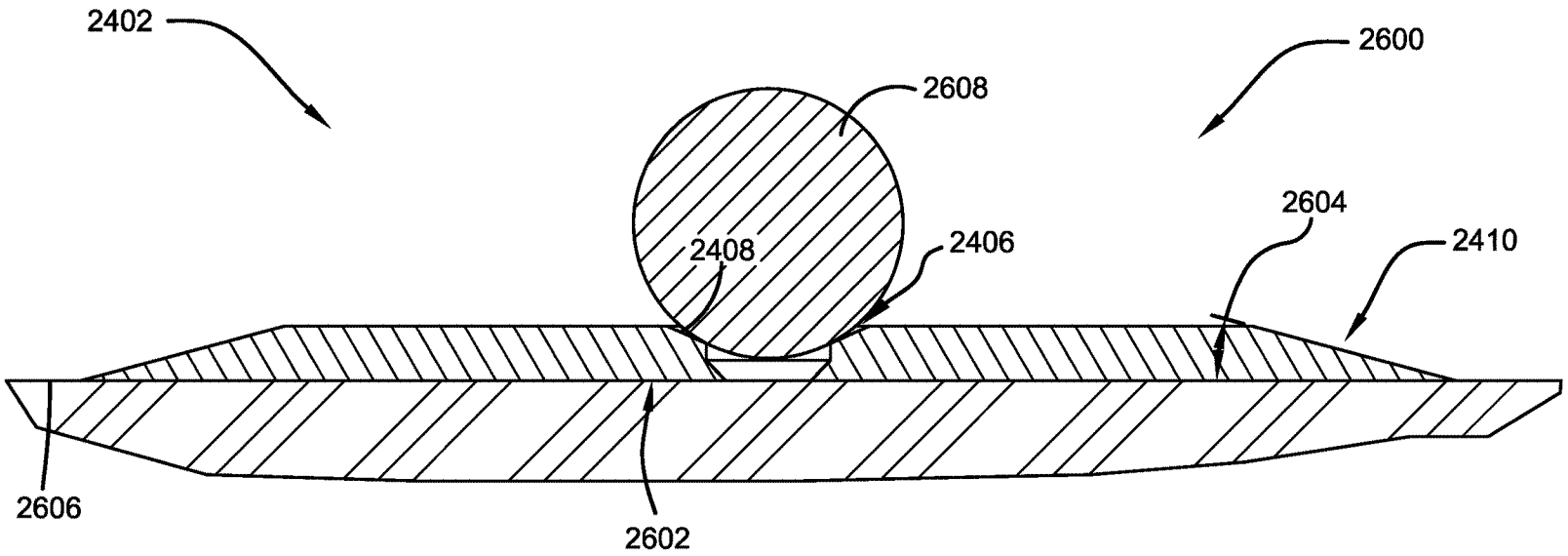
FIG. 26 is a cross-sectional view of the game piece disc.

In addition, as shown in FIG. 26, the disc may include an outer tapered surface 2410 that tapers radially outwardly in a direction from the top side 2404 to the bottom side 2602 of the disc. Such an outer tapered surface 2410 may have an acute angle 2604 of between 10 and 45 degrees (such as about 15 degrees), relative to a plan that includes the bottom side 2602. Such a disc 2402 may serve as a game piece by being positioned with the bottom side 2602 resting on the bed 2606 of a billiard table. Billiard games may then be played in which a billiard ball 2608 is shot so as to roll up the outer tapered surface 2410 and land on and come to rest on the central circular opening 2406.

Figure 27:
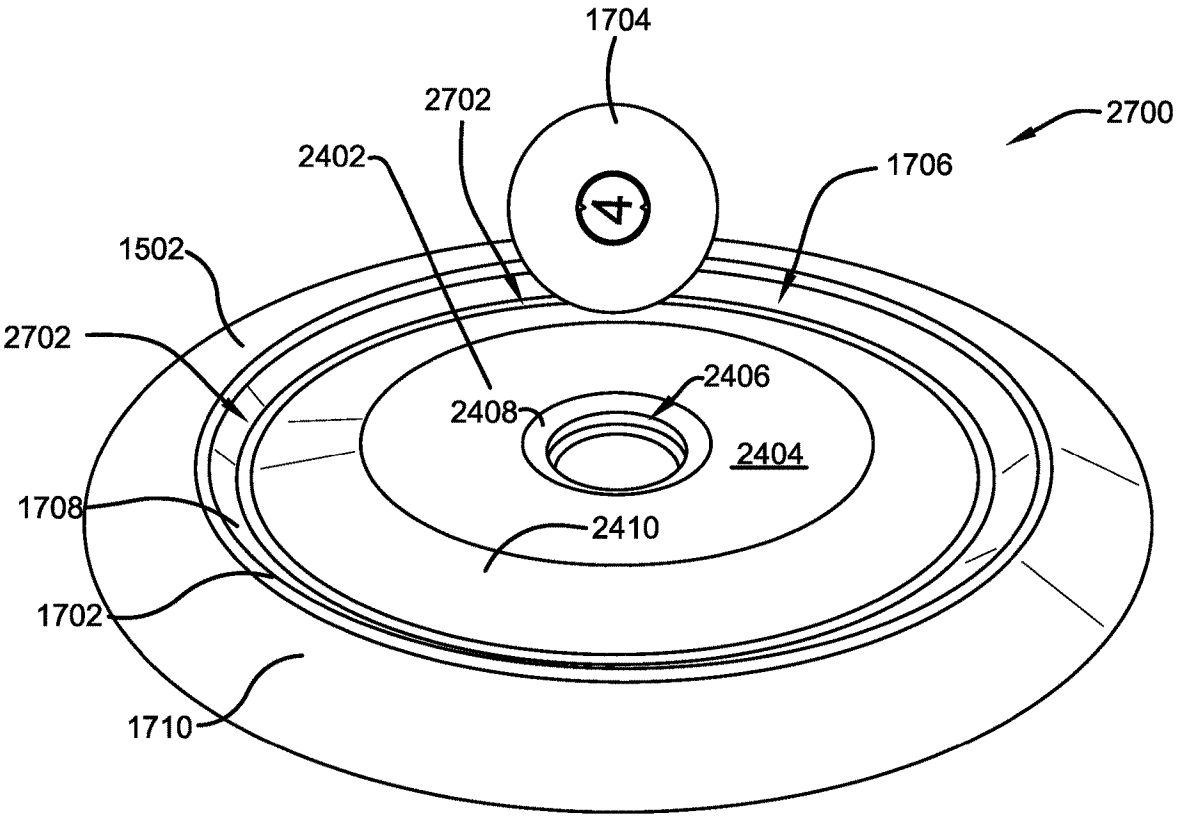
FIG. 27 is a perspective view of a game piece disc placed inside a flipped circular billiard rack.

Also, as illustrated in a top view 2700 in FIG. 27, in a further example game of billiards, the described disc 2402 may be placed inside the interior space 1706 of the circular billiard rack 1502. As illustrated in FIG. 27, the top side of the of the circular billiard rack 1502 is placed upside down on the billiard table, such that the bottom side 1702 faces upwardly. Also, the disc 2402 is orientated such that its top side 2404 faces upwardly. Thus, in this example the outer diameter of the disc is smaller than the inner diameter of the cam surface 1708 of the billiard rack.

With this arraignment the outer tapered surface 2410 of the disc is positioned adjacently inwardly of the cam surface 1708. As a result, these two tapered surfaces form a circular channel 2702 that is operative to receive a billiard ball 2704 thereon in contact with both tapered surfaces 1708, 2410. In this example, a billiard game may be played in which a ball is shot so as to roll up the outer tapered surface 1710 of the billiard rack and land on the circular channel 2702 in a direction and with sufficient momentum so as to begin to roll one or more times around the channel (e.g., the ball rolls in a circle one or more times). In example games, the time for the ball to travel around the channel and come to a stop may serve as a timer in which a player may be required to shoot one or more other billiard balls on the billiard table during a particular game of billiards.

It should also be noted that in some billiard games, a billiard ball may be shot up the tapered surfaces of either the described circular billiard rack or disc with sufficient momentum so as to fly through the air and land on another portion of the billiard table. In addition, it should be noted that in some billiard games, a billiard ball may be shot up the tapered surfaces of either the described circular billiard rack or disc with sufficient momentum so as to bank off of the tapered surface and roll in a different direction along the bed of the billiard table.

Also, in this example as shown in FIG. 27, the disc 2402 is shown as including the central circular opening 2406. However, it should also be appreciated that in alternative embodiments, the disc may not include the central circular opening 2406. Also, it should be appreciated that in alternative embodiments, the disc 2402 may include top sides with other surface configurations such as convex or concave surfaces to achieve different pathways upon which a billiard ball may move on the disc.

Referring back to FIG. 1, example embodiments of the described billiard rack 102 may include a plurality of spaced apart alignment marks 110 on the top side 108 of the billiard rack. In this example, the alignment marks may be positioned on or adjacent an outer circumferential edge 112 of the top side 108. In example embodiments, such alignment marks may be formed integrally in the plastic material or other material that forms the frame 104 of the billiard rack. For example in the frame may formed during a molding process which also produces the alignment marks (e.g., via raised or lowered molded markers and/or via layers of differently colored plastics).

Such alignment marks may also be formed via coatings such as paint or a label affixed to the frame 104. Also, such alignment marks may be formed by having the top surface include raised or recessed portions (e.g., such as a raised bump or a recessed notch generated via a molding or machining process). In this regard, FIG. 1 shows such alignment marks in the form of a recessed notch positioned on the circumferential edge 112. However, it should be appreciated that such alignment marks may be positioned at other locations on the top side 108 and/or the outer circumferential side wall 114.

Figure 28:
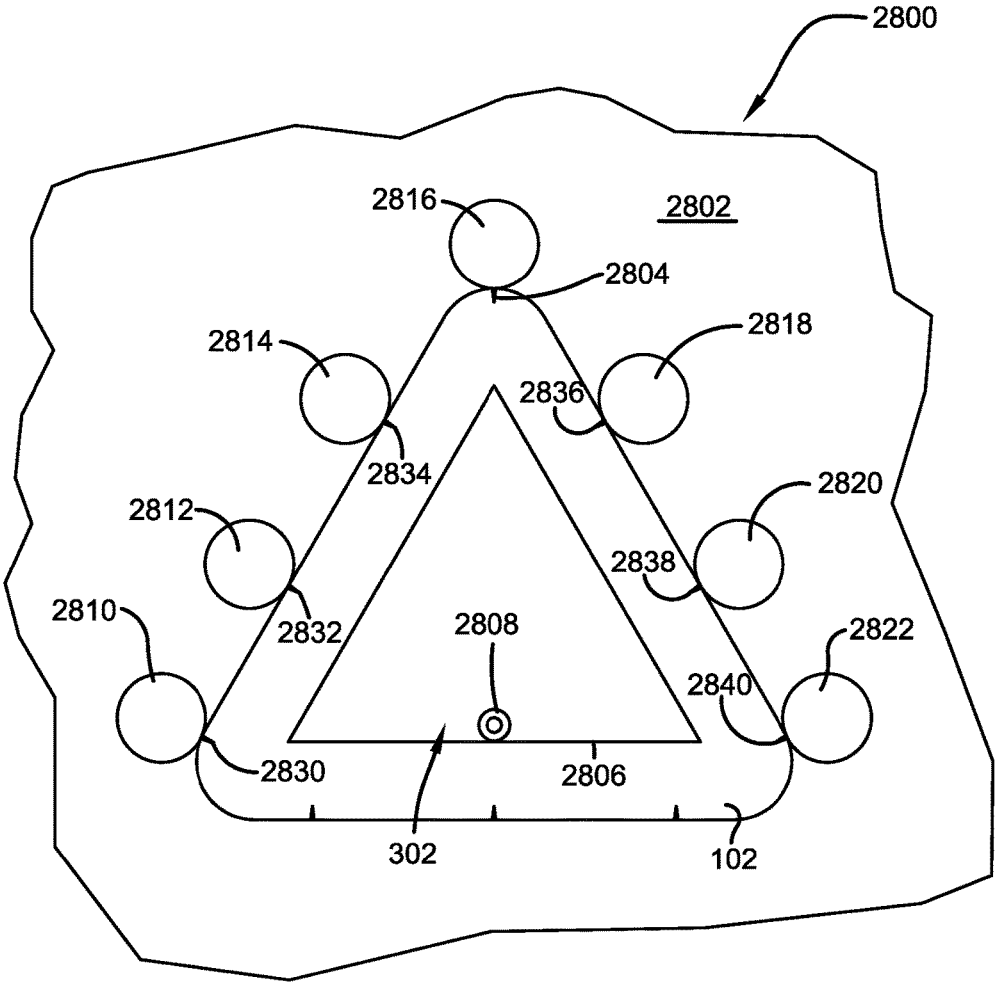
FIG. 28 shows an example manner in which an example billiard rack may be used to arrange billiard balls on a billiard table.
Figure 29A:
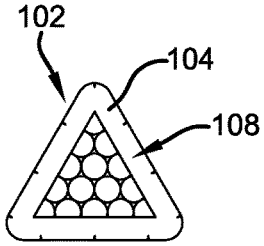
FIGS. 29A-N show examples of the generally triangularly shaped rack being used to rack several different arrangements of billiard balls.
Figure 29B:
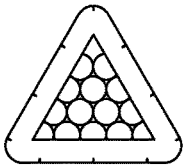
Figure 29C:
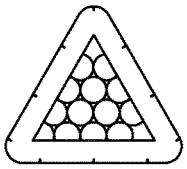
Figure 29D:
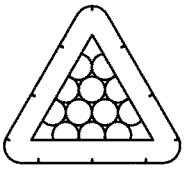
Figure 29E:
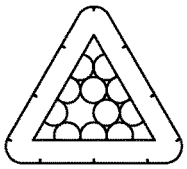
Figure 29F:
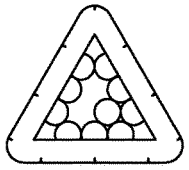
Figure 29G:
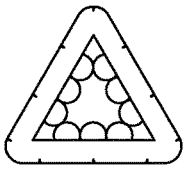
Figure 29H:
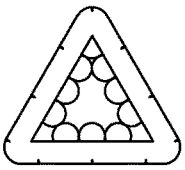
Figure 29I:
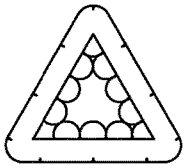
Figure 29J:
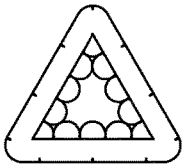
Figure 29K:
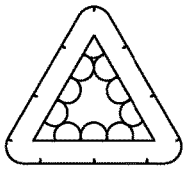
Figure 29L:
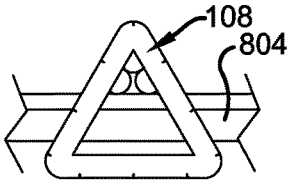
Figure 29M:
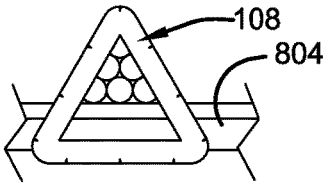
Figure 29N:
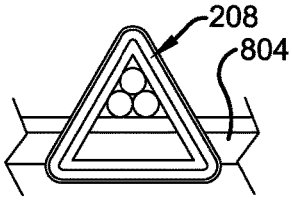
Figure 30A:
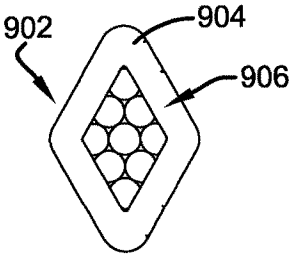
FIGS. 30A-J show examples of the generally non-square rhombus shaped rack being used to rack several different arrangements of billiard balls.
Figure 30B:
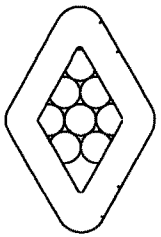
Figure 30C:
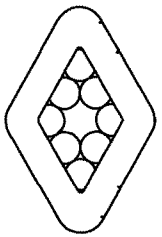
Figure 30D:
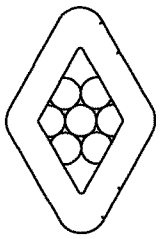
Figure 30E:
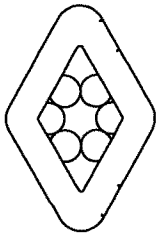
Figure 30F:
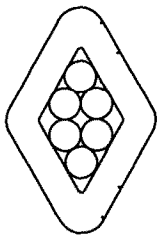
Figure 30G:
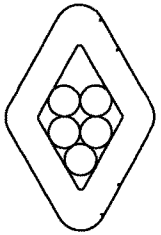
Figure 30H:
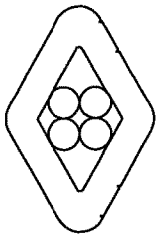
Figure 30I:
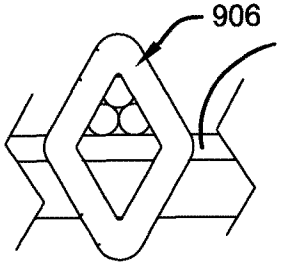
Figure 30J:
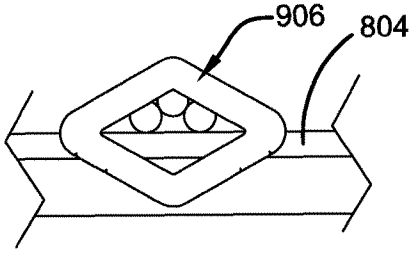

Such alignment marks may be positioned in locations on the top side of the frame of a rack to assist in positioning balls outside the billiard rack for particular billiard games. FIG. 28 illustrates an example arrangement 2800 in which the billiard rack 102 may be used as an alignment tool on a billiard table 2802. In this example, rather than placing the billiard rack on a set of billiard balls, the billiard rack 102 is placed directly on the bed of the billiard table 2802. Depending on the game being played, the location of a substantially straight inner edge 2806 of the upper opening 302 in the top side of the rack, may be aligned with an edge of one of the spots 2808 (e.g., the head, foot, or center spots) on the bed of the billiard table.

In order to align two billiard balls 2810, 2822 with the center of spot 2808, an example embodiment of the billiard rack 102 may include alignment marks 2830, 2840 that are located so as to be aligned with the inner edge 2806. With this arrangement, the inner edge 2806 extends along a line that is substantially horizontally aligned with both of the alignment marks 2830, 2840 on the outer circumferential edge of the top side of the frame.

In addition, in an example embodiment, the billiard rack may include additional alignment marks for use with aligning additional billiard balls. For example, on the same side of the billiard rack, an example billiard rack may include the alignment marks 2830 and two additional alignment marks 2832, 2834 which are used to align billiard balls 2810, 2812 and 2814 against the outer side wall of the frame of the billiard rack. Similarly, on the opposed side of the billiard rack, an example billiard rack may include the alignment marks 2840 and two additional alignment marks 2838, 2836 which are used to align billiard balls 2822, 2820 and 2818 against the opposed side wall of the frame of the billiard rack.

In addition, in one example, the alignment marks may be evenly spaced apart. However, in another example as illustrated in FIG. 28, the alignment marks may not be evenly spaced apart. Rather, in this described example, alignment mark 2832 is closer to alignment mark 2830 than alignment mark 2834. As a result, the billiard ball 2812 is closer to billiard ball 2810 than billiard ball 2840. Similarly, the alignment marks may be placed, such that when a corner billiard ball 2816 is placed adjacent the corner mark 2804 of the frame of the billiard rack, the side billiard ball 2814 is closer to the adjacent side billiard ball 2812 than to the corner billiard ball 2816. Similarly, the alignment marks 2840, 2838, 2836 may be spaced part to achieve a similar spacing on the opposed side of the rack, in which the spacing between the balls 2822, 2820, 2818, and 2816 increases in the direction from the lower most ball 2822 to the corner billiard ball 2816. This described spacing may enhance the perceived uniformity of the spacing between at least some of the billiard balls from the vantage point of a person looking across a billiard table with the front balls 2810 and 2822 facing closer towards the person standing at the opposite end of the billiard table.

In example embodiments, once the billiard balls have been aligned on a billiard table in the manner described above, the billiard rack may be removed from the table. Also, although the generally triangularly shaped billiard rack 102 has been described as including alignment marks, it should be appreciated that other embodiments of billiard racks described herein, such as the generally non-square rhombus shaped billiard rack 902 shown in FIG. 9, may include alignment marks as well.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A billiard rack comprising:

a frame that extends around an interior space, wherein the interior space has a size and shape into which an upper portion of each ball of a set including a plurality of uniformly sized billiard balls resting on a horizontal planar surface of a bed of a billiard table may simultaneously extend, wherein the interior shape includes a corner, wherein with all the balls of the set extending in the interior space, one ball only is positioned in the corner, wherein the surface of the bed includes an alignment mark visible from above the surface of the bed, wherein the frame includes a top side and an opposed bottom side, wherein the bottom side includes a lower opening into the interior space into which the upper portions of each ball of the set of billiard balls may extend, and wherein the bottom side comprises a portion of the rack that extends closest to the bed when the set of balls is positioned therein, wherein the top side includes an upper opening into the interior space that is larger than a billiard ball and is smaller in area than the lower opening, wherein the frame includes at least one inner wall that bounds the interior space, wherein each inner wall includes at least one cam surface that extends at least partially around the interior space, and wherein in transverse cross section the at least one cam surface tapers inwardly from the lower opening in the bottom side toward the upper opening, wherein the frame is operative such that when the frame is placed in engagement with the set of billiard balls resting on the horizontal planar surface of the bed of the billiard table and with all the balls of the set extending in the interior space, the at least one cam surface is operative to:

contact all peripheral billiard balls of the set of billiard balls; and with movement of the frame toward the horizontal planar surface of the bed, urge the set of billiard balls together, such that each billiard ball of the set is in contact with at least two other neighboring billiard balls and with the billiard balls of the set being urged by the at least one cam surface fully together in the interior space, no portion of the bottom side is enabled to move closer than one third of a diameter of one of the billiard balls to the horizontal planar surface of the bed of the billiard table upon which the billiard balls are resting, and wherein a bottom of the one ball in the corner is visible underneath the bottom side of the frame from above the surface of the bed simultaneously with the alignment mark such that the bottom of the ball in the corner is observable as the billiard balls in the interior space are moved with the frame and the bottom is positioned on top of the alignment mark on the surface of the bed.

2. A method of using a billiard rack that includes:

a frame that extends around an interior space, wherein the interior space has a size and shape into which an upper portion of each ball of a set including a plurality of uniformly sized billiard balls resting on a horizontal planar surface of a bed of a billiard table may simultaneously extend, wherein the shape includes a corner, wherein with all the balls of the set extending in the interior space, one ball only is positioned in the corner, wherein the surface of the bed includes an alignment mark visible from above the surface of the bed, wherein the frame includes a top side and an opposed bottom side, wherein the bottom side includes a lower opening into the interior space into which the upper portion& of each ball of the set of billiard balls may extend and wherein the bottom side comprises a portion of the rack that extends closest to the bed when the set of balls is positioned therein, wherein the top side includes an upper opening into the interior space that is larger than a billiard ball and is smaller in area than the lower opening, wherein the frame includes at least one inner wall that bounds the interior space, wherein each inner wall includes at least one cam surface that extends at least partially around the interior space, and wherein in transverse cross section the at least one cam surface tapers inwardly from the lower opening in the bottom side toward the upper opening, wherein the method comprises:

a) placing the frame on the set of billiard balls resting on the horizontal planar surface of the bed of the billiard table with all of the balls of the set extending in the interior space;

b) contacting with the at least one cam surface, all peripheral billiard balls of the set of billiard balls;

c) by moving the frame downward toward the horizontal planar surface of the bed urging by engagement of all the peripheral balls with the at least one cam surface, the set of billiard balls fully together, such that each billiard ball of the set is in contact with at least two other neighboring billiard balls and with the billiard balls of the set being urged fully together in the interior space by the at least one cam surface no portion of the frame bottom side is enabled to move closer than one third of a diameter of one of the billiard balls to the horizontal planar surface of the bed of the billiard table upon which the billiard balls are resting, wherein a bottom of the one ball in the corner is visibly observable underneath the frame bottom side from above the surface of the bed simultaneous with the alignment mark;

d) moving the frame with the set of billiard balls therein to visibly align the bottom of the one ball in the corner on top of the visible alignment mark on the planar surface of the billiard table by visibly observing the bottom of the one ball moving to on top of the alignment mark from above the surface of the bed while moving the frame;

e) with the bottom of the one ball in the corner aligned on the visible mark and subsequent to (d), lifting the frame off of the set of billiard balls.

3. A billiard rack comprising:

a frame that extends around an interior space, wherein the interior space has a size and shape into which may extend simultaneously an upper portion of each ball of a set including a plurality of uniformly sized billiard balls resting on a horizontal planar surface of a bed of a billiard table, wherein the billiard table includes an upward extending cushion rail that bounds the horizontal planar surface, wherein the frame includes a top side and an opposed bottom side, wherein the bottom side includes a lower opening into the interior space into which the upper portion of each ball of the set of billiard balls may extend, and wherein the bottom side comprises a portion of the rack that extends closest to the bed when the set of balls is positioned therein, wherein the top side includes an upper opening into the interior space that is larger than a billiard ball and is smaller in area than the lower opening, wherein the frame includes at least one inner wall that bounds the interior space, wherein each inner wall includes at least one cam surface, wherein the at least one cam surface extends at least partially around the interior space, and wherein in transverse cross section the at least one cam surface tapers inwardly from the lower opening in the bottom side toward the upper opening, wherein when the frame is in engagement with the set of billiard balls resting on the horizontal planar surface of the bed of the billiard table and with all the balls of the set extending in the interior space, the at least one cam surface:

contacts all peripheral billiard balls of the set of billiard balls; and with downward movement of the frame relative to the surface of the bed, urges the set of billiard balls fully together, such that each billiard ball is in contact with at least two other neighboring billiard balls, and wherein with the billiard balls of the set being urged by the at least one cam surface fully together in the interior space, all portions of the frame are disposed upwardly and away from the horizontal planar surface of the bed of the billiard table upon which the billiard balls are resting such that all portions of the frame are vertically higher than the cushion rail, whereby with the balls of the set urged fully together by engagement with the frame, at least one ball of the set is engageable in direct contact with the cushion rail.

4. The billiard rack according to claim 3, wherein each billiard ball has a spherical shape with an outer diameter of between 2.0 inches (50.8 mm) and 2.5 inches (63.5 mm), wherein the at least one cam surface is tapered inwardly toward a center of the frame and has a cross-sectional width of at least 0.5 inches (12.7 mm) in a plane that is perpendicular to the cam surface and the bottom side.

5. The billiard rack according to claim 4, wherein the interior space of the frame has a shape that is operative to receive and rack sets of billiards balls with different numbers of billiard balls for each set, such that each set extends into the lower opening and the at least one cam surface engages all of the peripheral billiard balls of each set of billiard balls and urges each set of billiard balls together, such that each billiard ball is in contact with at least two neighboring billiard balls.

6. The billiard rack according to claim 5, wherein the frame and the lower opening have generally triangular shapes, wherein the interior space of the frame has a shape that receives a set of fifteen billiard balls simultaneously extending into the lower opening and the at least one cam surface engages all twelve peripheral billiard balls of the set of fifteen billiard balls and urges the set of fifteen billiard balls together in a generally triangular shape, such that each billiard ball is in contact with at least two neighboring billiard balls.

7. The billiard rack according to claim 5, wherein the frame and the lower opening have generally non-square rhombus shapes, wherein the interior space of the frame has a shape that receives a set of nine billiard balls extending into the lower opening with the at least one cam surface in contact with all eight of the peripheral billiard balls of the set of nine peripheral billiard balls and urging the set of nine billiard balls together in a generally non-square rhombus shape, such that each billiard ball is in contact with at least two neighboring billiard balls.

8. The billiard rack according to claim 7, wherein the interior space of the frame has a shape that at different times is operative to receive a set of nine billiard balls, a set of eight billiard, a set of seven billiard balls, a set of six billiard balls, a set of five billiard balls, and a set of four billiard balls extending into the lower opening with the at least one cam surface in contact with all of the peripheral billiard balls of each respective set of billiard balls and urging the respective set of billiard balls together, such that each billiard ball is in contact with at least two neighboring billiard balls for each respective set of billiard balls.

9. The billiard rack according to claim 5, wherein the top side of the frame includes a substantially planar top surface that extends around the upper opening, wherein the bottom side of the frame includes a substantially planar bottom surface that extends around the lower opening and that is parallel to the planar top surface, wherein the substantially planar top surface of the frame has a width of at least 1.0 inches (25.4 mm) and the substantially planar bottom surface of the frame has a width of at least 0.5 inches (12.7 mm) in directions that extend radially from a center axis of the frame, wherein the at least one cam surface extends from the bottom side towards to top side at acute angles between 30 and 60 degrees with respect to a plane that includes the substantially planar bottom surface, wherein the frame includes a circumferential outer side surface that extends between the top side and bottom side of the frame, wherein the outer side surface includes a beveled portion having a channel that has a depth that is operative to receive tips of human fingers therein in order to facilitate grasping and lifting of the frame off of the set of billiard balls, wherein the frame has a weight sufficient to cause each set of billiard balls to be moved together, such that each billiard ball is in contact with at least two neighboring billiard balls without having to apply any external downward force on the frame.

10. The billiard rack according to claim 3, wherein the top side of the frame includes an outer circumferential edge, wherein the top side of the frame includes a plurality of spaced apart alignment marks adjacent the outer circumferential edge, wherein the spaced apart alignment marks include notches that extend into the outer circumferential edge of the top side of the frame, wherein a billiard ball on the bed outside the interior space is visibly alignable with a respective notch in the circumferential edge while the frame is positioned relative to a mark on the bed that is visible through the interior space.

11. The billiard rack according to claim 3, wherein the top side of the frame includes an outer circumferential edge, wherein the top side of the frame includes a plurality of spaced apart alignment marks at the outer circumferential edge, wherein the top side of the frame includes at least one substantially straight inner edge along the top opening, wherein when the bottom side of the frame is placed with the entire bottom side parallel to a horizontal surface, the at least one straight inner edge extends along a line that is substantially horizontally aligned with at least one alignment mark at the outer circumferential edge of the top side of the frame.

12. The method according to claim 2, wherein in (a) the frame and the lower opening have generally triangular shapes, wherein (a) includes placing the frame on a set of only fifteen billiard balls, wherein (b) includes the at least one cam surface contacting all twelve of the peripheral billiard balls of the set of fifteen billiard balls, wherein (c) includes the at least one cam surface urging the set of fifteen billiard balls together in a generally triangular shape, such that each billiard ball is in contact with at least two neighboring billiard balls.

13. The method according to claim 2, wherein in (a) both the frame and the lower opening have generally non-square rhombus shapes, wherein (a) includes placing the frame on a set of only nine billiard balls, wherein (b) includes the at least one cam surface contacting all eight of the peripheral billiard balls of the set of nine billiard balls, wherein (c) includes the at least one cam surface urging the set of nine billiard balls together in a generally non-square rhombus shape, such that each billiard ball is in contact with at least two neighboring billiard balls.

14. The method according to claim 2, wherein in (a) the top side of the frame includes a substantially planar top surface that extends around the upper opening, wherein the bottom side of the frame includes a substantially planar bottom surface that extends around the lower opening and that is parallel to the planar top surface, wherein the substantially planar top surface of the frame has a width of at least 1.0 inches (25.4 mm) and the substantially planar bottom surface of the frame has a width of at least 0.5 inches (12.7 mm) in directions that extend radially from a center axis of the frame, wherein in (b) and (c) the at least one cam surface extends from the bottom side towards to top side at acute angles between 30 and 60 degrees with respect to a plane that includes the substantially planar bottom surface, wherein the frame includes a circumferential outer side surface that extends between the top side and bottom side of the frame, wherein the outer side surface includes a beveled portion having a channel therein, wherein the frame has a weight that urges all the billiard balls of the set fully together in (c) without applying any external downward force on the frame, further comprising:

f) prior to (d) placing tips of human fingers adjacent the channel.

15. The method according to claim 2, wherein in (a) the top side of the frame includes an outer circumferential edge, wherein the top side of the frame includes a plurality of spaced apart frame alignment marks adjacent the outer circumferential edge, wherein the spaced apart frame alignment marks include notches that extend into the outer circumferential edge of the top side of the frame, further comprising:

f) aligning the frame with a further visible alignment mark on the bed that is visible through the interior space, g) with the frame aligned in (e) aligning at least one billiard ball on the bed and outside the interior space, with a notch in the outer circumferential edge.

16. The method according to claim 2, wherein in (a) the frame and the upper and lower openings have a circular shape, wherein the frame includes a circumferential outer side surface that extends between the top side and bottom side of the frame and that tapers inwardly in directions from the top side to the bottom side of the frame, further comprising:

repeating steps (a) through (d) with different sets of billiard balls including a set of ten billiard balls and a set of nine billiard balls, wherein (b) includes the at least one cam surface contacting all of the billiard balls in each set, wherein (c) includes the at least one cam surface urging the billiard balls together for each set into a ring arrangement, such that each billiard ball is in contact with at least two neighboring billiard ball in each set.

17. The method according to claim 2, wherein in (a) the frame and the upper and lower openings have a circular shape, wherein the frame includes a circumferential outer side surface that extends between the top side and bottom side of the frame and that tapers inwardly in directions from the top side to the bottom side of the frame, further comprising:

f) flipping the frame over and placing the top side of the frame on the billiard table;

g) placing a disc on the billiard table inside the interior space of the frame, wherein the disc has an outer diameter that is less than an inner diameter of the upper opening of the frame, wherein the disc includes a circumferential outer side surface that extends between a top side and a bottom side of the disc and that tapers inwardly in directions from the bottom side to the top side of the disc;

h) shooting a billiard ball with a cue stick in order to drive the billiard ball up the outer side surface of the frame so as to land in contact with and roll along both the outer side surface of the disc and the at least one cam surface of the frame.

18. The billiard rack according to claim 3 wherein the frame and the upper and lower openings have a circular shape, wherein the frame includes a circumferential outer side surface that extends between the top side and bottom side of the frame and that tapers inwardly in directions from the top side to the bottom side of the frame, wherein the billiard rack further comprises:

a disc, having an outer diameter that is less than an inner diameter of the upper opening of the frame, wherein the disc includes a circumferential outer side surface that extends between a top side and a bottom side of the disc and that tapers inwardly in directions from the bottom side to the top side of the disc, wherein the top side of the disc includes a central aperture having a diameter that is less than the diameter of a billiard ball, wherein when the top side of the frame is placed on the billiard table the disc is positioned on the billiard table inside the interior space of the frame such that a billiard ball may be driven up the outer side surface of the frame so as to land in contact with and roll along both the outer side surface of the disc and the at least one cam surface of the frame.

19. The billiard rack according to claim 3, wherein the cam surface comprises a flexible resilient material, and wherein with the frame in engagement with the set of billiard balls the at least one cam surface is in compressed contact with at least some of the peripheral billiard balls.

20. The billiard rack according to claim 3, wherein the interior space of the frame has a shape that is operative to receive and rack sets of billiards balls with different numbers of billiard balls for each set, such that each set extends into the lower opening with the at least one cam surface operative to contact all of the peripheral billiard balls of each set of billiard balls and urge each set of billiard balls together, such that each billiard ball is in contact with at least two neighboring billiard balls.

21. A billiard rack comprising:

a frame that extends around an interior space, wherein the frame has a circular shape, wherein the interior space of the frame has a shape that is operative to receive and rack sets of billiards balls in a ring arrangement; and a disc, wherein the disc has an outer diameter that is less than an inner diameter of the frame, wherein the disc includes a circumferential outer side surface that extends between a top side and a bottom side of the disc and that tapers inwardly in directions from the bottom side to the top side of the disc, wherein the top side of the disc includes a central aperture having a diameter that is less than the diameter of a billiard ball.

22. The billiard rack according to claim 21, wherein the interior space has a size and shape that is configured to receive therein upper portions of a set of billiard balls resting on a horizontal planar surface of a bed of a billiard table, wherein the frame includes a top side and an opposed bottom side, wherein the bottom side includes a lower opening into the interior space which is configured such that the upper portions of the set of billiard balls are able to extend therein, wherein the top side includes an upper opening into the interior space that is larger than a billiard ball and is smaller in area than the lower opening, wherein the frame includes an inner wall having at least one cam surface that extends at least partially around the interior space and that tapers inwardly in directions from the lower opening to the upper opening, wherein the frame is configured such that when the frame is placed on the set of billiard balls resting on the horizontal planar surface of the bed of the billiard table, the at least one cam surface is configured to:

contact all of the peripheral billiard balls of the set of billiard balls; and urge the set of billiard balls together, such that each billiard ball is in contact with at least two other neighboring billiard balls.

23. The billiard rack according to claim 22, wherein the upper and lower openings have a circular shape, wherein the interior space of the frame has a shape that is operative to receive and rack sets of billiards balls in a ring arrangement with different numbers of billiard balls for each set including a set of ten billiard balls, and a set of nine billiard balls, such that each set extends into the lower opening with the at least one cam surface configured to contact all of the billiard balls of each set of billiard balls and urge each set of billiard balls together, such that each billiard ball is in contact with at least two neighboring billiard balls.

24. A billiard rack comprising:

a frame that extends around an interior space, which space has a size and shape that is configured to receive therein upper portions of a set of billiard balls resting on a horizontal planar surface of a bed of a billiard table, wherein the frame includes a top side and an opposed bottom side, wherein the bottom side includes a lower opening into the interior space which is configured such that the upper portions of the set of billiard balls are able to extend therein, wherein the top side includes an upper opening into the interior space that is larger than a billiard ball and is smaller in area than the lower opening, wherein the frame includes an inner wall having at least one cam surface that extends at least partially around the interior space and that tapers inwardly in directions from the lower opening to the upper opening, wherein the frame is configured such that when the frame is placed on the set of billiard balls resting on the horizontal planar surface of the bed of the billiard table, the at least one cam surface is configured to:

contact all of the peripheral billiard balls of the set of billiard balls; and urge the set of billiard balls together, such that each billiard ball is in contact with at least two other neighboring billiard balls and no portion of the frame comes closer than one third of the diameter of one of the billiard balls to the horizontal planar surface of the bed of the billiard table upon which the billiard balls are resting, wherein each billiard ball has a spherical shape with an outer diameter of between 2.0 inches (50.8 mm) and 2.5 inches (63.5 mm), wherein the at least one cam surface is tapered inwardly toward a center of the frame and has a cross-sectional width of at least 0.5 inches (12.7 mm) in a plane that is perpendicular to the cam surface and the bottom side, wherein the interior space of the frame has a shape that is operative to receive and rack sets of billiards balls with different numbers of billiard balls for each set, such that each set extends into the lower opening with the at least one cam surface configured to contact all of the peripheral billiard balls of each set of billiard balls and urge each set of billiard balls together, such that each billiard ball is in contact with at least two neighboring billiard balls, wherein the frame and the upper and lower openings have a circular shape, wherein the interior space of the frame has a shape that is operative to receive and rack sets of billiards balls in a ring arrangement with different numbers of billiard balls for each set including a set of ten billiard balls, and a set of nine billiard balls, such that each set extends into the lower opening with the at least one cam surface configured to contact all of the billiard balls of each set of billiard balls and urge each set of billiard balls together, such that each billiard ball is in contact with at least two neighboring billiard balls, wherein the frame includes a circumferential outer side surface that extends between the top side and bottom side of the frame and that tapers inwardly in directions from the top side to the bottom side of the frame; and a disc, wherein the disc has an outer diameter that is less than an inner diameter of the upper opening of the frame, wherein the disc includes a circumferential outer side surface that extends between a top side and a bottom side of the disc and that tapers inwardly in directions from the bottom side to the top side of the disc, wherein the top side of the disc includes a central aperture having a diameter that is less than the diameter of a billiard ball.

* * * * *